US008134464B2

(12) United States Patent
Lynch et al.

(10) Patent No.: US 8,134,464 B2
(45) **Date of Patent: *Mar. 13, 2012**

(54) ELECTRONIC ARTICLE SURVEILLANCE TAG HAVING A DETRIMENTAL SUBSTANCE EXPULSION SYSTEM WITH BREAKABLE VIAL

(75) Inventors: John L. Lynch, Boynton Beach, FL (US); Franklin H. Valade, Jr., Fort Walton Beach, FL (US); Krystyna E. Cwik, Plantation, FL (US); Craig R. Szklany, Lighthouse Point, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 536 days.

This patent is subject to a terminal disclaimer.

(21) Appl. No.: 12/223,549

(22) PCT Filed: Feb. 7, 2007

(86) PCT No.: PCT/US2007/003397

§ 371 (c)(1), (2), (4) Date: Aug. 1, 2008

(87) PCT Pub. No.: WO2007/092567

PCT Pub. Date: Aug. 16, 2007

(65) Prior Publication Data

US 2009/0021378 A1 Jan. 22, 2009

Related U.S. Application Data

(60) Provisional application No. 60/771,410, filed on Feb. 7, 2006, provisional application No. 60/771,411, filed on Feb. 7, 2006.

(51) Int. Cl.
*G08B 13/14* (2006.01)

(52) U.S. Cl. ..... 340/572.1

(58) Field of Classification Search .... 340/572.1–572.9; 24/704.1

See application file for complete search history.

(56) References Cited

U.S. PATENT DOCUMENTS

| | | | | |
|---|---|---|---|---|
| 3,942,829 | A | 3/1976 | Humble et al. | |
| 3,991,594 | A | 11/1976 | Goenner | |
| 4,356,477 | A | 10/1982 | Vandebult | |
| 4,429,302 | A | 1/1984 | Vandebult | |
| 4,506,630 | A | 3/1985 | Hair | |
| 4,510,489 | A | 4/1985 | Anderson, III et al. | |
| 4,510,490 | A | 4/1985 | Anderson, III et al. | |
| 4,603,326 | A | 7/1986 | Freed | |
| 4,686,516 | A * | 8/1987 | Humphrey | 340/572.3 |
| 4,797,658 | A | 1/1989 | Humphrey | |
| 5,031,756 | A | 7/1991 | Buzzard et al. | |
| 5,054,172 | A | 10/1991 | Hogan et al. | |

(Continued)

FOREIGN PATENT DOCUMENTS

| | | |
|---|---|---|
| EP | 0594324 A2 | 4/1994 |

(Continued)

*Primary Examiner* — Phung Nguyen

(57) ABSTRACT

An EAS/expulsion detrimental substance tag (101) in which the tag is held to an article by an attaching assembly, a part of which may be releasably prevented from being withdrawn from the body of the tag. The tag body may be provided with one or more sensors, that are disposed in the body. The sensors are positioned adjacent the detrimental substance. The Benefit Denial (Ink portion) of this tag may feature an ink vial. When the tag and its ink vial are attacked, the tag will expel the detrimental substance out and onto the article being protected.

37 Claims, 22 Drawing Sheets

U.S. PATENT DOCUMENTS

| | | | | |
|---|---|---|---|---|
| 5,309,740 | A * | 5/1994 | Hansen | 70/57.1 |
| 5,426,419 | A | 6/1995 | Nguyen et al. | |
| 5,428,875 | A | 7/1995 | Nguyen et al. | |
| 5,535,606 | A | 7/1996 | Nguyen et al. | |
| 5,680,681 | A | 10/1997 | Fuss | |
| 6,029,322 | A | 2/2000 | Belotti et al. | |
| 6,373,390 | B1 * | 4/2002 | Hogan et al. | 340/572.8 |
| 6,449,991 | B1 | 9/2002 | Hogan | |
| 6,754,939 | B2 | 6/2004 | Belden et al. | |
| 7,023,348 | B2 | 4/2006 | Hogan et al. | |
| 7,183,917 | B2 | 2/2007 | Piccoli et al. | |
| 7,633,396 | B2 * | 12/2009 | Lynce et al. | 340/572.8 |
| 2004/0239505 | A1 | 12/2004 | Hogan et al. | |
| 2005/0001726 | A1 | 1/2005 | Valade et al. | |
| 2005/0255262 | A1 | 11/2005 | Nomula et al. | |
| 2006/0097872 | A1 | 5/2006 | Ho | |
| 2007/0024448 | A1 | 2/2007 | Sayegh | |
| 2007/0205902 | A1 | 9/2007 | Cote et al. | |

FOREIGN PATENT DOCUMENTS

| | | |
|---|---|---|
| WO | WO 96/17332 | 6/1996 |
| WO | WO 01/79635 | 10/2001 |

* cited by examiner

ELECTRONIC ARTICLE SURVEILLANCE TAG HAVING A DETRIMENTAL SUBSTANCE EXPULSION SYSTEM WITH BREAKABLE VIAL

BACKGROUND OF THE INVENTION

1. Field of the Invention

This invention relates generally to security tags and associated detachers and, more particularly, to a Security/Ink or other Detrimental Substance tag and a security tag detacher for use in electronic article surveillance (EAS) systems.

2. Description of the Related Art

Electronic article surveillance systems are well known in the art and are used for inventory control and to prevent theft and similar unauthorized removal of articles from a controlled area. Typically, in such systems a system transmitter and a system receiver are used to establish a surveillance zone, which must be traversed by any article being removed from the controlled area.

An EAS tag is affixed to each article and includes a marker or sensor adapted to interact with a signal being transmitted by the system transmitter into the surveillance zone. This interaction causes a further signal to be established in the surveillance zone, which further signal is received by the system receiver. Accordingly, upon movement of a tagged article through the surveillance zone, a signal will be received by the system receiver, identifying the unauthorized presence of the tagged article in the zone.

Certain types of EAS tags have been designed to be reusable and, thus, include releasable attachment devices for affixing the tag to the articles. Such attachment devices are further designed to be releasable by authorized personnel only so that unauthorized removal of a tag from its article is avoided. To this end, many attachment devices are made releasable only through the use of an associated special tool or detaching mechanism or other device.

An EAS tag employing an attachment device and an associated detacher is described in U.S. Pat. No. 3,942,829 (the "'829 patent") entitled REUSABLE SECURITY TAG, issued to Humble, et al. on Mar. 9, 1976 and assigned to same assignee hereof. The EAS tag of the '829 patent includes a tag body and an attachment device in the form of a tack assembly. The tack assembly includes an enlarged head and tack body having a pointed end, which serves to pierce through an article and to be receivable in and clamped to the tag body. This secures the article and tag together.

In the tag of the '829 patent, the tack is clamped to the tag body using a spring clamp formed as a clutch lock with spreadable jaws. Once the article is pierced, the pointed tack end is received in the tag body and is secured between the jaws of the clutch lock. This locks the tack and the tag body, forming or securing the EAS tag to the article so that the tag and article cannot be readily separated from each other.

In order for authorized personnel to be able to release the tack from the clutch lock and, therefore, the tag from the article, the '829 patent utilizes a detacher mechanism which is adapted to grip the tag body and apply a bending force thereto. This force is sufficient to deform the clutch so that the jaws of the clutch lock are spread apart, thereby releasing the tack. The tack can then be removed from the tag body so that the article and tag become separated from one another.

To permit the bending of the tag body sufficiently to deform the clutch lock, the tag body of the '829 patent may be made of a flexible material. Typically, flexible plastic materials such as, for example, polypropylene, have been used. Such materials, however, are susceptible to being cut and damaged. This tends to be a disadvantage, since it increases the likelihood that the locking feature of the tag can be separated from the EAS sensor part of the tag or can be exposed and defeated.

Moreover, the tag body of the '829 patent may be relatively large in size in order to facilitate its flexing. This likewise tends to be a disadvantage, since use of large tags detracts from the aesthetic appearance of the articles to which the tags are attached.

Another type of EAS security device is known in which a variation of the spring clamp of the '829 patent has been incorporated into a so-called keeper for a compact disc. This type of device is disclosed in U.S. Pat. No. 5,031,756, entitled KEEPER FOR COMPACT DISC PACKAGE OR THE LIKE, issued to Buzzard, et al. on Jul. 16, 1991 and also assigned to same assignee hereof.

The keeper of the '756 patent comprises a rigid plastic frame. One side of the frame is provided with an enlarged section which houses a tack-like button assembly and a spring clamp as in the '829 patent. In this case, the spring clamp is used to lock the button assembly in a first position. In this position, the pointed end of the button assembly protrudes into the frame to pierce and hold to the frame a cardboard container containing a compact disc. As a result, unauthorized removal of the compact disc with the frame causes an EAS sensor also incorporated into the frame, to generate a detectable signal for alarming an EAS system.

In the keeper of the '756 patent, the enlarged section of the frame is provided with opposing linear slots, which lead to the region between the jaws of the spring clamp. By inserting ramped linear fingers into these slots, the fingers are guided into this region, causing the jaws to flex outward. This releases the button enabling it to be withdrawn from the cardboard container. The container and its housed compact disc can then be separated from the frame.

While the keeper of the '756 patent utilizes a spring clamp of the '829 patent type in a rigid frame, it also has certain drawbacks. One drawback is that the linear slots leading to the spring clamp permit in-line viewing and access to the clamp. This increases the susceptibility of the clamp to defeat, since linear objects can be inserted into the slots in an attempt to open the jaws. Another drawback is that the fingers of the detacher are required to be of high precision, since they must be received in the region between the spring clamp jaws. This increases the cost and complexity of the detacher.

U.S. Pat. No. 5,426,419 (the "'419 patent"), entitled SECURITY TAG HAVING ARCUATE CHANNEL AND DETACHER APPARATUS FOR SAME, issued to Nguyen, T. et al., on Jun. 20, 1995, and assigned to the same assignee hereof, the disclosure of which is incorporated herein by reference, discloses an EAS tag that does not suffer from the above disadvantages. The EAS tag has a hard tag body, which is adapted to be releasable from an article in an easy and simple manner by insertion of the arcuate probe of an associated detacher device into an arcuate channel of the tag to release a spring clamp mechanism. The spring clamp mechanism is a releasable locking mechanism that prevents removal of an assembly that is adapted for insertion through an article, which is captured when inserted into an opening in a portion of the tag body. The EAS tag of the '419 patent is more difficult to defeat than the above tags, but can be defeated by insertion of a segment of relatively rigid metal bent in an arcuate manner to simulate the arcuate probe of the associated detacher device, as fully described herein below.

BRIEF DESCRIPTION OF THE DRAWINGS

The above and other features and aspects of the invention will become more apparent upon reading the following detailed description in conjunction with the accompanying drawings, in which.

DETAILED DESCRIPTION OF THE INVENTION

Figure 1:
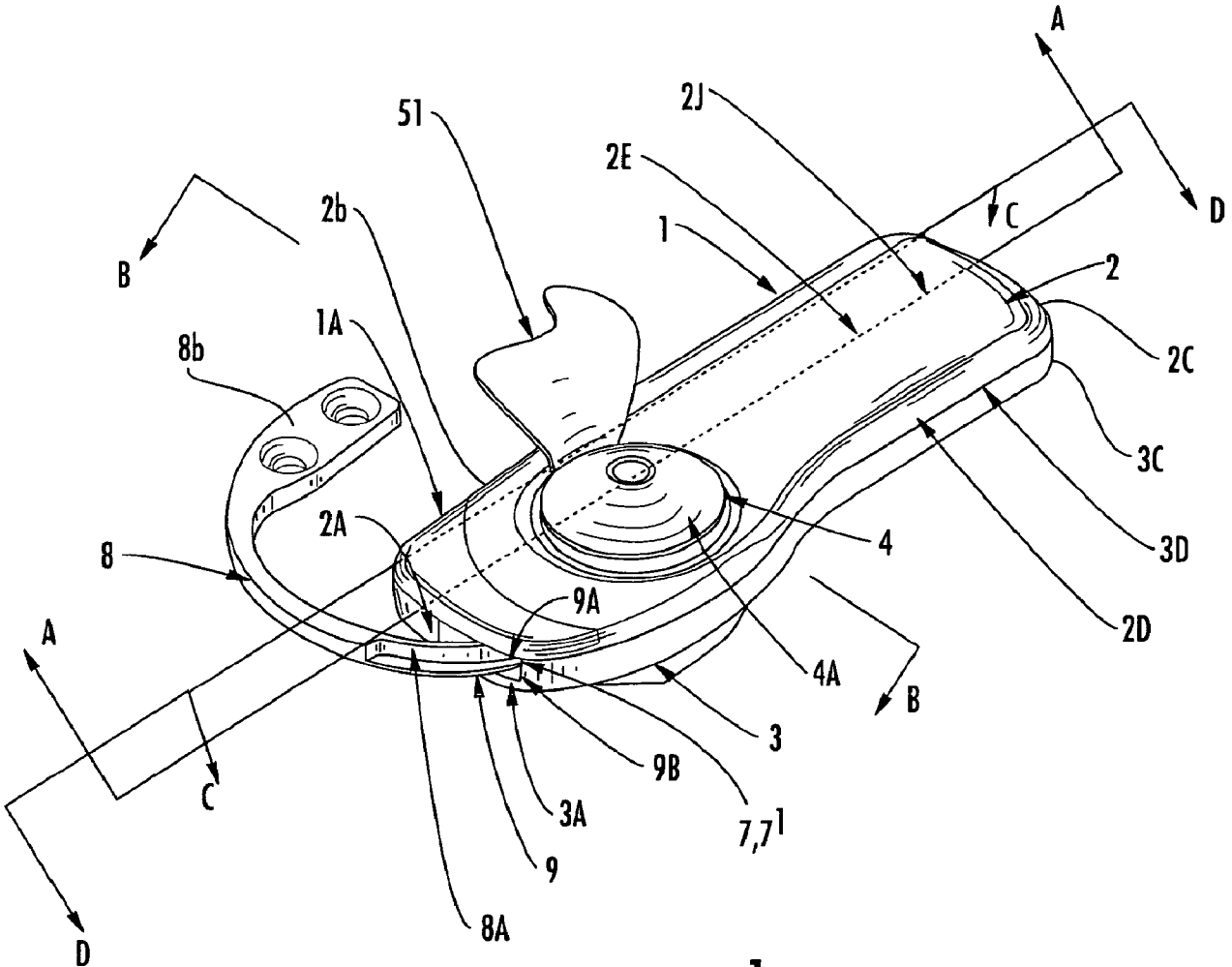
FIG. 1 shows an EAS/expulsion detrimental substance tag and associated detacher, an arcuate probe, in accordance with one embodiment.

Embodiments may be directed to apparatuses, systems and methods including, in accordance with the principles of the invention, an EAS tag comprising a tag body and an attaching assembly for attaching the tag body to an article. The attaching assembly may include a tack assembly or other part, which is receivable in the tag body, and the tag body may be provided with a spring clamp or other preventing mechanism for releasably preventing withdrawal of the attaching assembly part. A channel defining structure within the tag body may define an arcuate channel. This channel may lead to the preventing mechanism and may permit an arcuate probe to be guided to the preventing mechanism for releasing same. Release of the preventing mechanism may permit withdrawal of the attaching assembly part, thereby separating the attaching assembly and article from the tag body. An abutment within the arcuate channel may prevent the insertion of a relatively rigid wire, formed substantially in the arcuate shape of the arcuate probe, into the arcuate channel far enough to release the preventing mechanism.

The ink portion of this tag may include a two breaker plate design mechanism that will disperse the detrimental substance onto the article being protected. If the tag is attacked, this detrimental substance may be forced into a channel located in or near the rampart area of the tag. When a thief tries to cut the tag, the ink vial may be crushed (see, e.g., the embodiment of FIG. 11) and the detrimental substance may flow through the tag channel (see, e.g., the embodiment of FIG. 12), out the hole, and may then stain the article being protected.

In an embodiment of the invention, the attaching assembly includes a tack assembly having a head and a tack body, the latter being the part of the attaching mechanism receivable in the tag body through a first opening. The preventing mechanism may include a receiving and clutching mechanism, or two jaws, which may receive and clutch the tack body, thereby preventing withdrawal of the tack body from the tag body. A release part adjacent the receiving and clutching mechanism when engaged may cause the receiving and clutching mechanism to release, thereby allowing withdrawal of the tack body. A second opening in the tag body may lead to the arcuate channel which, in turn, may lead to the release part adjacent the receiving and clutching mechanism to allow the arcuate probe to engage same to affect the release.

In one embodiment, the abutment mechanism is a substantially planar rigid member with a vertical and horizontal opening forming a substantially "L" shaped opening to receive a corresponding "L" shape of the arcuate probe. The rigid member may be positionable substantially perpendicular in the arcuate channel, and the vertical opening may be sized and positioned to allow a vertical member of the "L" shape of the arcuate probe to closely pass through when the arcuate probe is inserted into the arcuate channel to release the preventing mechanism.

The plastic (or other material) abutment may include a catch for catching the formed wire and preventing further insertion of the wire into the arcuate channel. The abutment may be molded into the EAS tag body and bias the catch against a wall of the arcuate channel and in front of the vertical opening in the rigid member.

A horizontal member of the "L" shaped arcuate probe may push against the bias upon insertion of the arcuate probe in the arcuate channel, wherein the catch may be pushed away from the vertical opening in the rigid member, allowing the arcuate probe to closely pass there through. The catch may be a bent portion of the end of the spring.

It is worthy to note that any reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

Numerous specific details may be set forth herein to provide a thorough understanding of the embodiments. It will be understood by those skilled in the art, however, that the embodiments may be practiced without these specific details. In other instances, well-known methods, procedures and components have not been described in detail so as not to obscure the embodiments. It can be appreciated that the specific structural and functional details disclosed herein may be representative and do not necessarily limit the scope of the embodiments.

FIGS. 1-8 show embodiments of various views of an EAS tag 1 (also referred to herein as "tag 1") in accordance with the principles of the invention as disclosed in U.S. Pat. No. 5,426,419, which has been incorporated herein by reference, a portion of the description of which follows herein. The description of the invention, which may be an improvement to EAS tag 1 in one embodiment, is fully described thereafter. As shown in FIG. 1, the tag 1 may include an upper housing 2 having side walls 2A, 2B, 2C and 2D, which may be joined by a top wall 2E. The tag 1 may also include a lower housing 3 having side walls 3A, 3B (shown in the embodiments of FIGS. 2, 4, 6A-6B, and 7), 3C and 3D, which may be joined by a bottom wall 3E. The upper and lower housings 2 and 3 may be joined or mated along corresponding or associated side wall pairs (2A, 3A), (2B, 3B), (2C, 3C) and (2D, 3D) to form a closed tag body 1A.

The upper and lower housings 2 and 3 may be made of a hard or rigid material, or another material or materials. A useable rigid or hard material might be hard plastic such as, for example, an injected molded ABS plastic. If a plastic is used, the mating side walls (2A-2D, 3A-3D) of the upper and lower housings 2 and 3 may be joined by an ultrasonic weld 1B or like joining mechanism, or by another mechanism for joining or otherwise securing the upper and lower housings 2 and 3 together.

Figure 3:
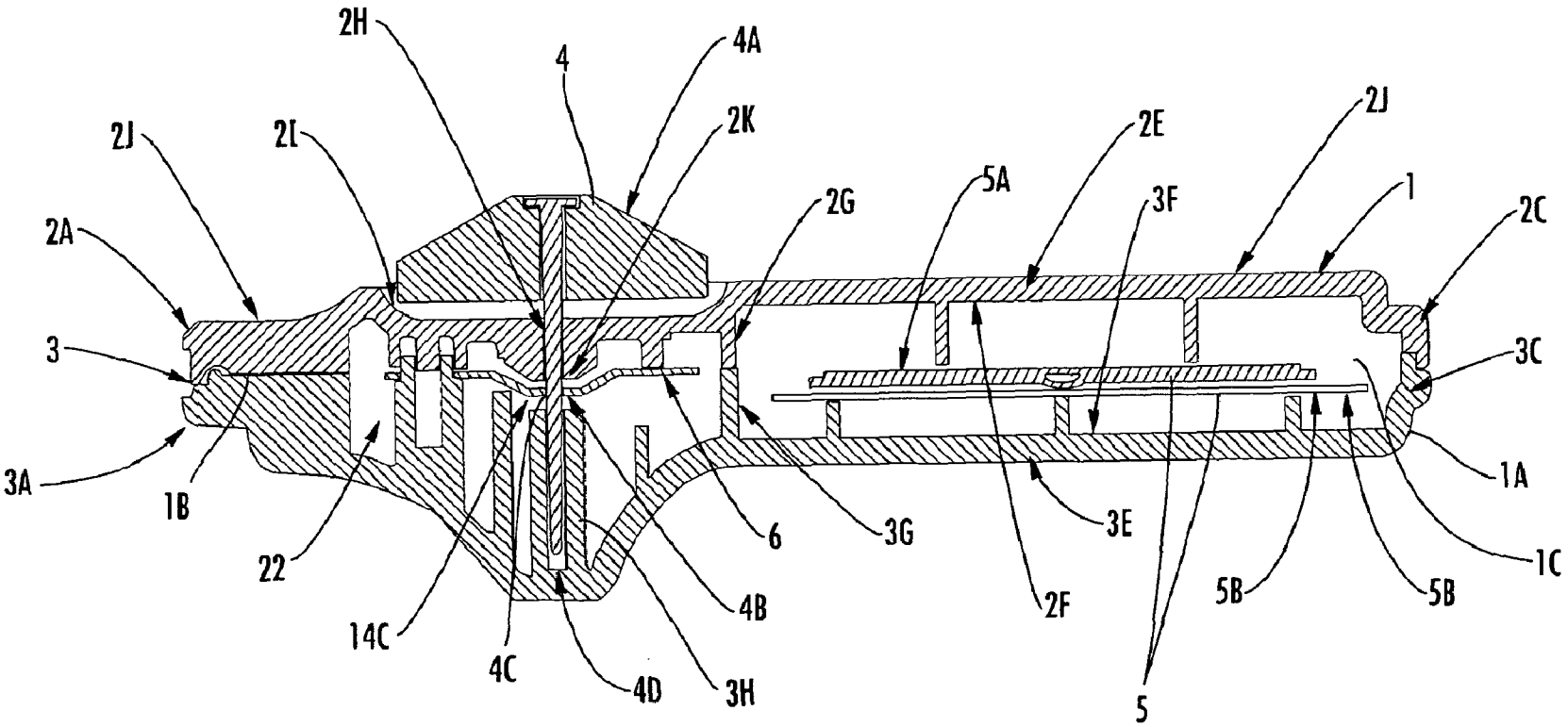
FIG. 3 shows a cross-section of the EAS tag of FIG. 1 taken along the line A-A, in accordance with one embodiment.
Figure 6A:
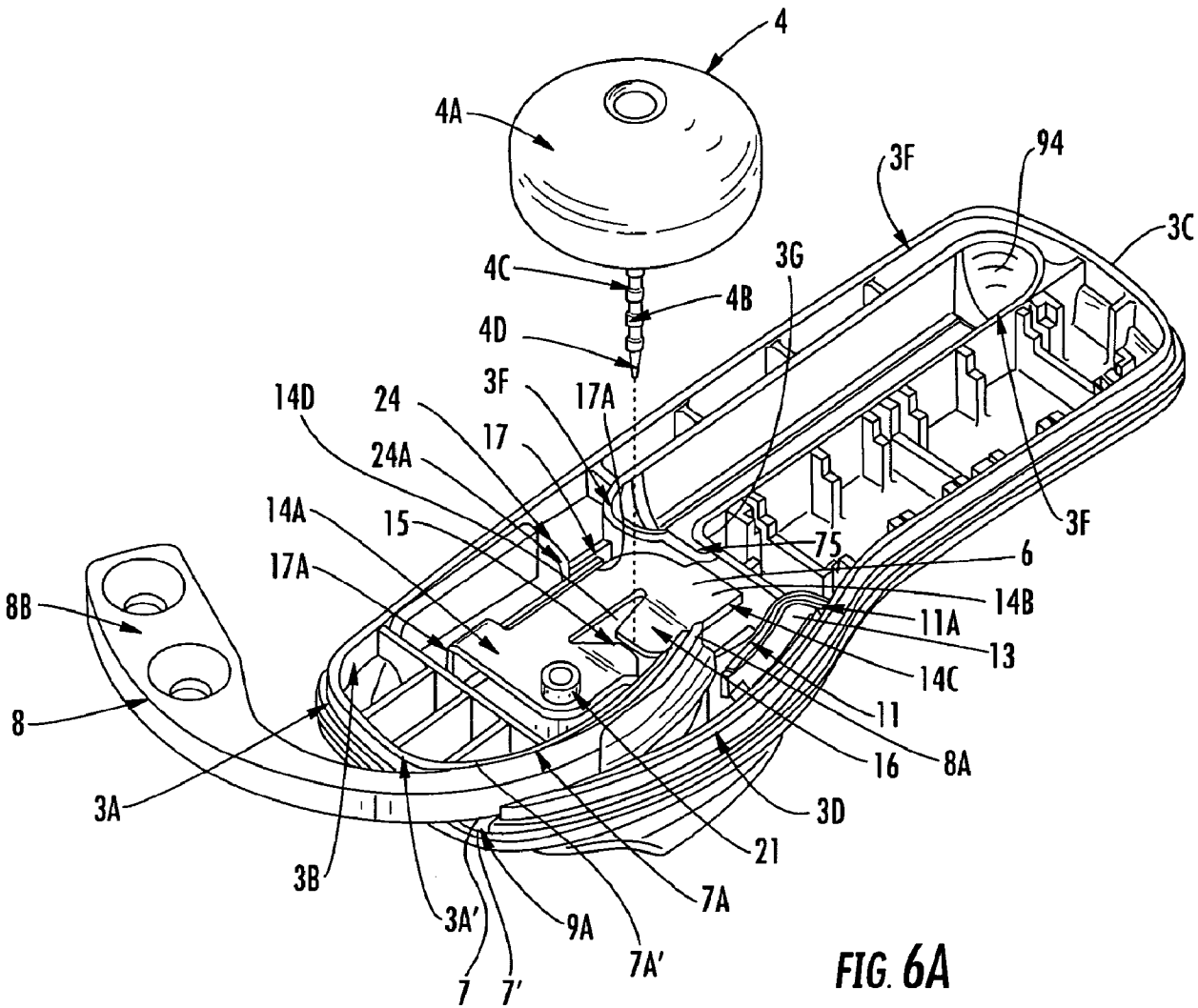
FIGS. 6A and 6B show views of the interior of the lower housing of the EAS tag in FIG. 1 with the arcuate probe inserted in the arcuate channel of the tag, in accordance with one embodiment.

The tag 1 may further include a tack assembly 4 shown as having an enlarged tack head 4A and an elongated tack body 4B provided with slots or grooves 4C and a pointed forward end 4D (see, e.g., the embodiments of FIGS. 1, 3, and 6A). The tack assembly 4 may be used to attach the tag body 1A to an article 51, which may be protected by the EAS tag 1. The tack assembly 4 may thus be retained at least partially within the tack body 1A when locked, as described below, to the tack body 1A.

Figure 2:
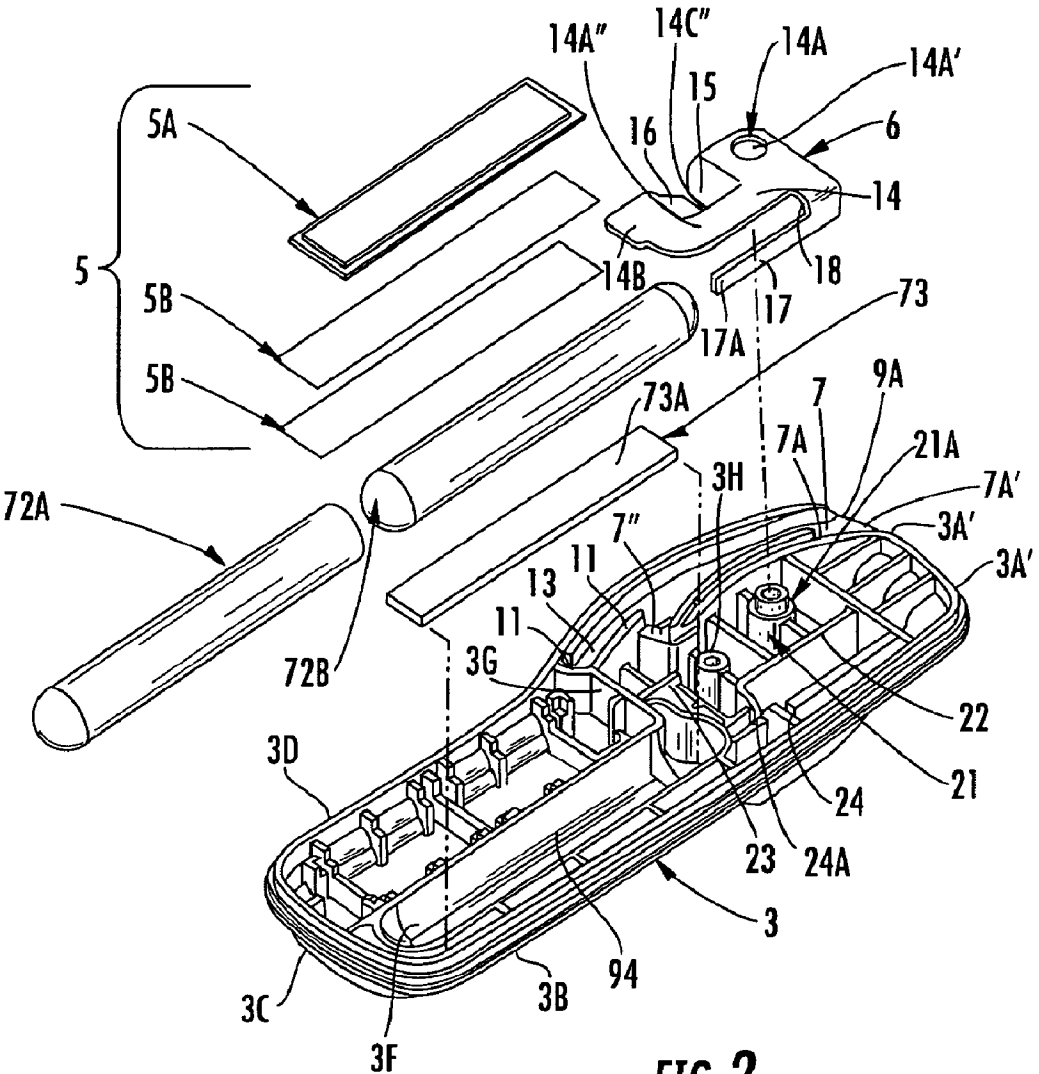
FIG. 2 shows interior components and the lower housing of the EAS tag of FIG. 1, in accordance with one embodiment.

In order to sense the tag 1 and, therefore, detect the presence of the tag 1 and the attached article 51, the inner surfaces 2F and 3F of the walls 2E and 3E of the housings 2 and 3 may be provided with frame members 2G and 3G, which together may define an interior cavity 1C (see the embodiment of FIG. 3) for receiving an EAS sensor, the sensor 5, which may include one or more linear amorphous resonators 5A and possibly also a magnetized bias 5B (see the embodiments of FIGS. 2 and 3). The sensor 5 may be otherwise disposed in the tag body 1A. The EAS sensor 5 may generate detectable signals and can be, in one embodiment, an acoustically resonant magnetic sensor as disclosed in U.S. Pat. Nos. 4,510,489 and 4,510,490. Possible other magnetic EAS sensors that may be included in the sensor 5 might be those disclosed in U.S. Pat. Nos. 4,686,516 and 4,797,658 and RF EAS sensors disclosed in U.S. Pat. Nos. 4,429,302 and 4,356,477.

In various other embodiments, the sensor 5 may include any sensor capable of generating a detectable signal, such as a magnetic, acoustic magnetic, electromagnetic, ferrite assembly, Radio-Frequency (RF), Radio-Frequency identification (RFID), or any combination of two or more of the aforementioned and any other electronic article surveillance (EAS) or other sensors.

The signal generated by the sensor 5 may be detected by an EAS monitoring system. The EAS monitoring system may include, for example, a transmitter/receiver ("transceiver") to detect the signals, and inform a monitoring system of the presence or absence of the tag 1 in the surveillance zone.

As above-noted, the article 51 may be joined to the tag body 1A by the tack assembly 4. This may be accomplished by inserting the tack body 4B into an opening 2H in the wall 2E of the upper housing 2. When the tack body 4B is fully inserted, the pointed end 4D of the tack may be received in an upstanding cavity or collar 3H extending from the inner surface 3F of the lower housing wall 3E. The tack head 4A, in turn, may be seated in a recessed area defined by the rampart area 2I, in the upper surface 2J, which is the outer surface of the wall 2E and thus part of the outer surface of the tag body 1A. The rampart area 2I may include the portion of the upper surface 2J delineating a recess in the wall 2E at its upper surface 2J. The rampart area 2I may also form the opening 2H through which the tack body 4B may extend. The tack body 4B may thus extend through the opening 2H of the recess and into the tag body 1A to engage the member 6 with a slot 4C, such as described below, to lock the tack assembly 4 to the member 6 and thus to the tag body 1A. The member 6 may be a spring clamp, and may thus be referred to herein as a "spring clamp 6." If the tack body 4B is also extended through the article 51, the article 51 or a portion thereof may thus be held between the tack head 4A and the wall 2E. In this position, at least a portion of the article 51, and possibly also at least a portion of the tack head 4A, may extend into the recess delineated by the rampart area 2I when the tack assembly 4B is locked to the spring clamp 6. Thus, in one embodiment, the recess may be shaped and sized large enough to receive at least a portion of the tack head 4A.

Spring clamp 6 to be discussed in greater detail below may be provided within the tag body 1A for releasably preventing the tack body 4B from being withdrawn from the tag body 1A. The tack assembly 4 and the article 51 may thus become releasably locked to the EAS tag 1 by the spring clamp 6.

The EAS tag 1 may be further adapted so that access to the spring clamp 6 for releasing same is made difficult for other than authorized personnel. To this end, the tag body 1A may be configured so that access to the spring clamp 6 is through an arcuate channel 7 (see the embodiments of FIGS. 1, 2, 4, 5A, 5B, 6A and 6B) defined by one or more inner walls and by parts of the side walls and upper and lower walls of the tag body 1A. The arcuate channel 7 may extend from a position adjacent the spring clamp 6 to the outside of the tag body 1A. With this configuration, a special arcuate probe 8 may be used to reach and release the spring clamp 6 and, thus, detach the tack assembly 4 and the article from the tag body 1A.

As shown, the arcuate channel 7 may be defined, in part, by a curved inner wall 7A. This wall may extend upward from the inner surface 3F of the bottom housing 3 to abut the inner surface 2F of the upper housing 2. The wall 7A may be further spaced from the side wall 3D of the bottom housing 3 and its outward end 7A' may terminate at an inward curved part 3A' of the side wall 3A. The inward curved part 3A' of the wall 3A may result in a space or slot 9A between the side walls 3A and 3D of the lower housing 3.

The slot 9A may cooperate with a similar slot 9B between the side walls 2A and 2D of the upper housing 2 to define a second opening 9 for providing entry or access into the outward end 7' of the arcuate channel 7. At this entry point, the side wall 2A may also curve inwardly at a part 2A', and the latter part 2A' may mate with the curved side wall part 3A' of the side wall 3 of the lower housing 3.

The arcuate channel 7 may be further defined by a second curved wall 7B (see the embodiments of FIGS. 5A and 7) extending downwardly from the inner surface 2F of the upper housing 2. The wall 7B may be situated outward of the inner end 7A" (see the embodiment of FIG. 7) of the curved wall 7A and may extend beyond this end to the frame member 2G.

Figure 7:
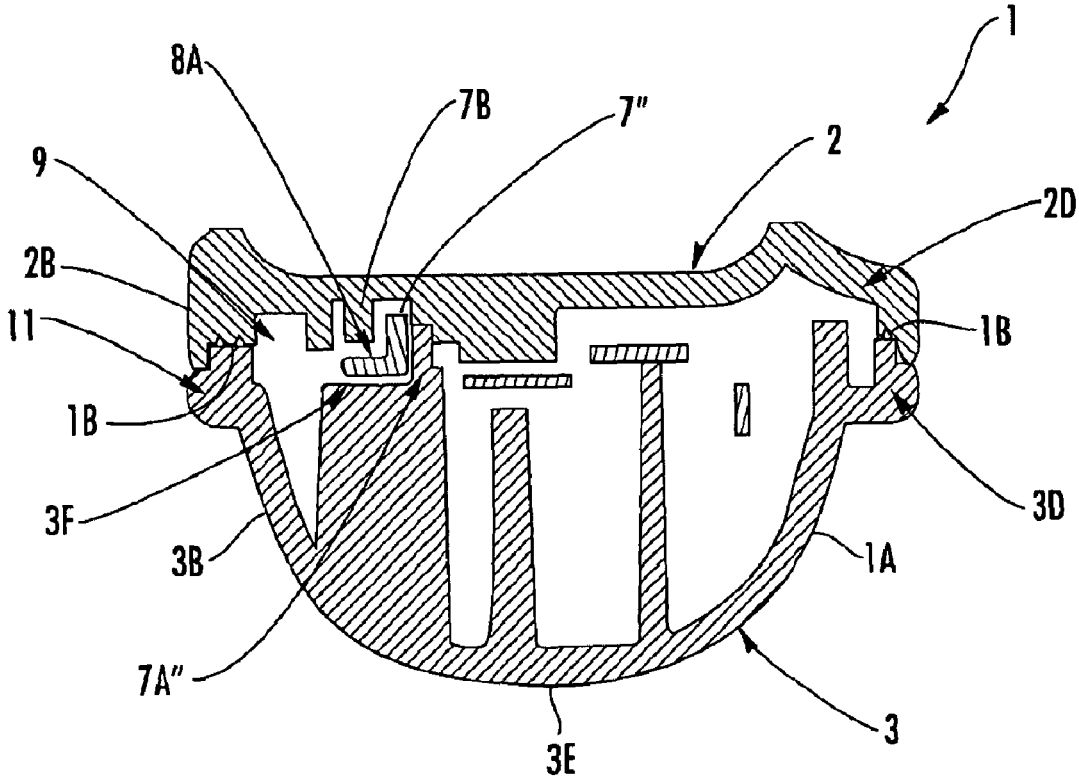
FIG. 7 is a cross section of the EAS tag of FIG. 1 taken along the line B-B, with the arcuate probe inserted in the arcuate channel in the tag, in accordance with one embodiment.

The presence of the wall 7B may change or alter the configuration of the arcuate channel 7 at its inner end 7", which end may lie adjacent the spring clamp 6 (see the embodiment of FIG. 7). This change or alteration in configuration may define a keyway for the arcuate channel 7, which may be accommodated by the arcuate probe 8 to pass through the arcuate channel 7 and gain access to the spring clamp 6.

As illustrated, the wall 7B may change the arcuate channel 7 cross section from substantially rectangular to substantially L-shaped. This is illustrated in the cross section of FIG. 7, which has been taken along the line B-B in FIG. 1 so that the cross section of the arcuate channel 7 end is made visible.

Figure 6B:
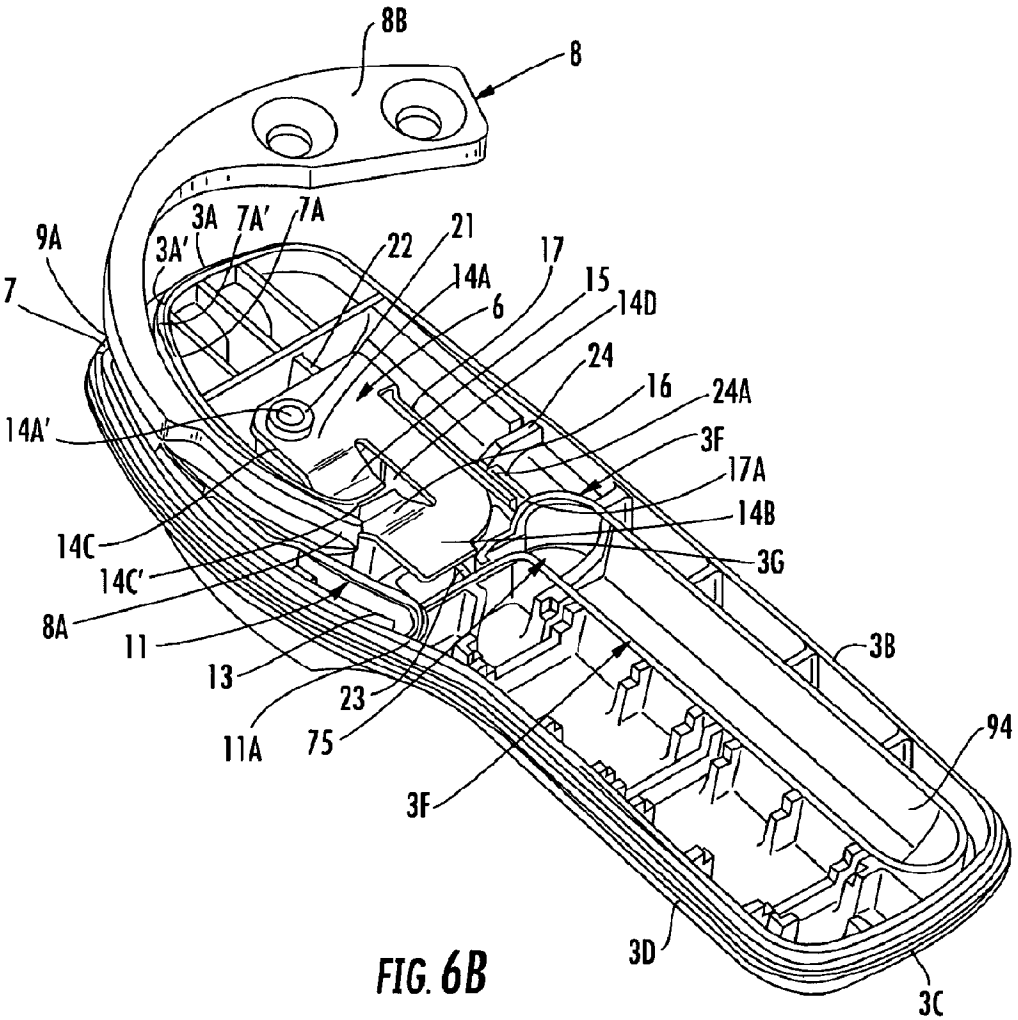

FIGS. 6A and 6B are views of the lower housing 3 containing the spring clamp 6 and the arcuate channel 7, in accordance with one embodiment. In the embodiment shown in FIGS. 6A-6B, the arcuate probe 8 is shown as received in and guided by the arcuate channel 7 to the spring clamp 6 for the purpose of releasing same. As can be seen, the forward end 8A of the probe 8 may be recessed so as to be L-shaped in cross section and, thus, fit within the L-shaped keyway defined by the inner end 7" (shown in the embodiment of FIG. 7) of the arcuate channel 7. In the embodiment shown in FIG. 6B, the arcuate probe 8 is also shown as disposed in the arcuate channel 7.

Figure 5A:
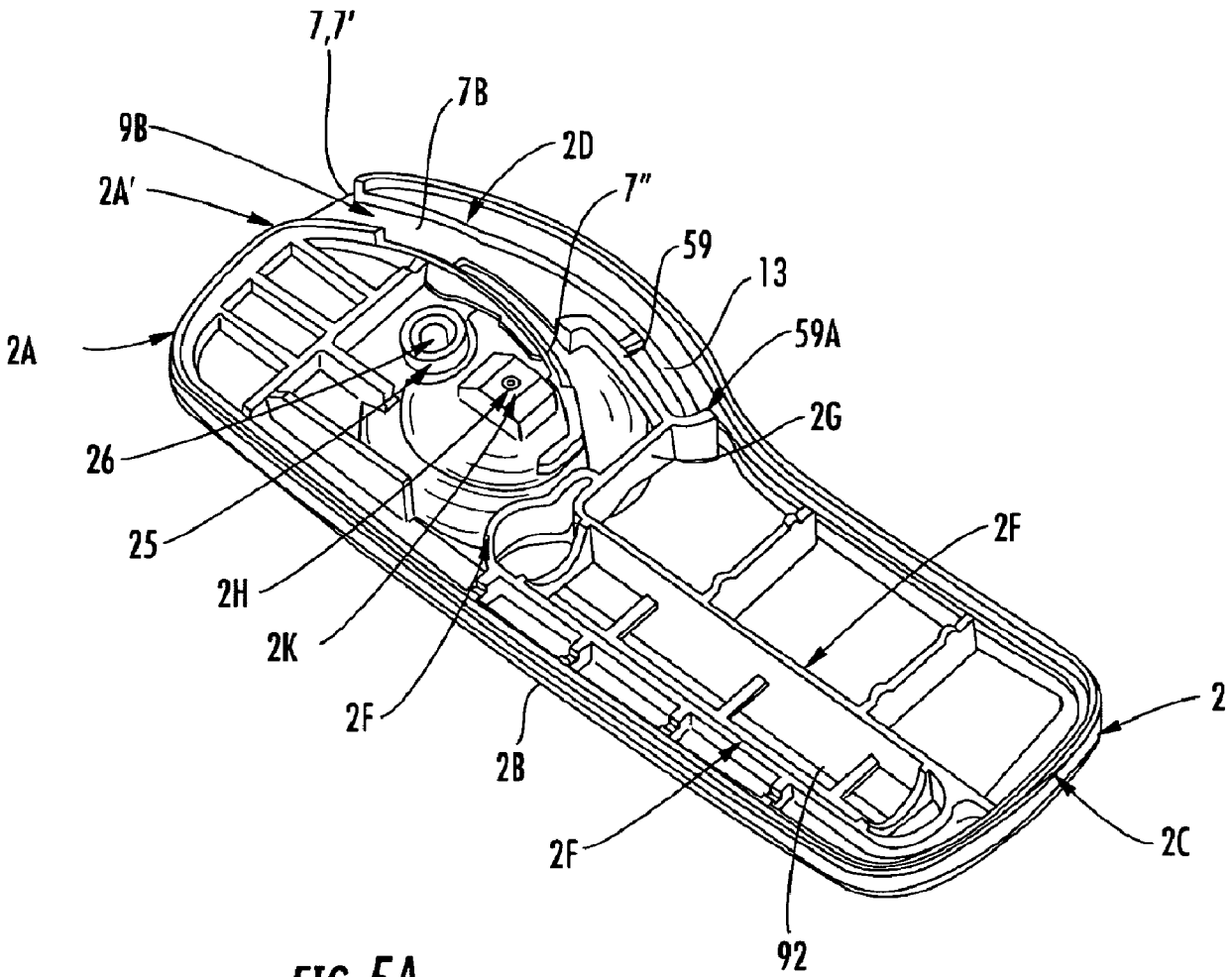
FIG. 5A shows a view of the interior of the upper housing of the EAS tag of FIG. 1, in accordance with one embodiment.
Figure 5B:
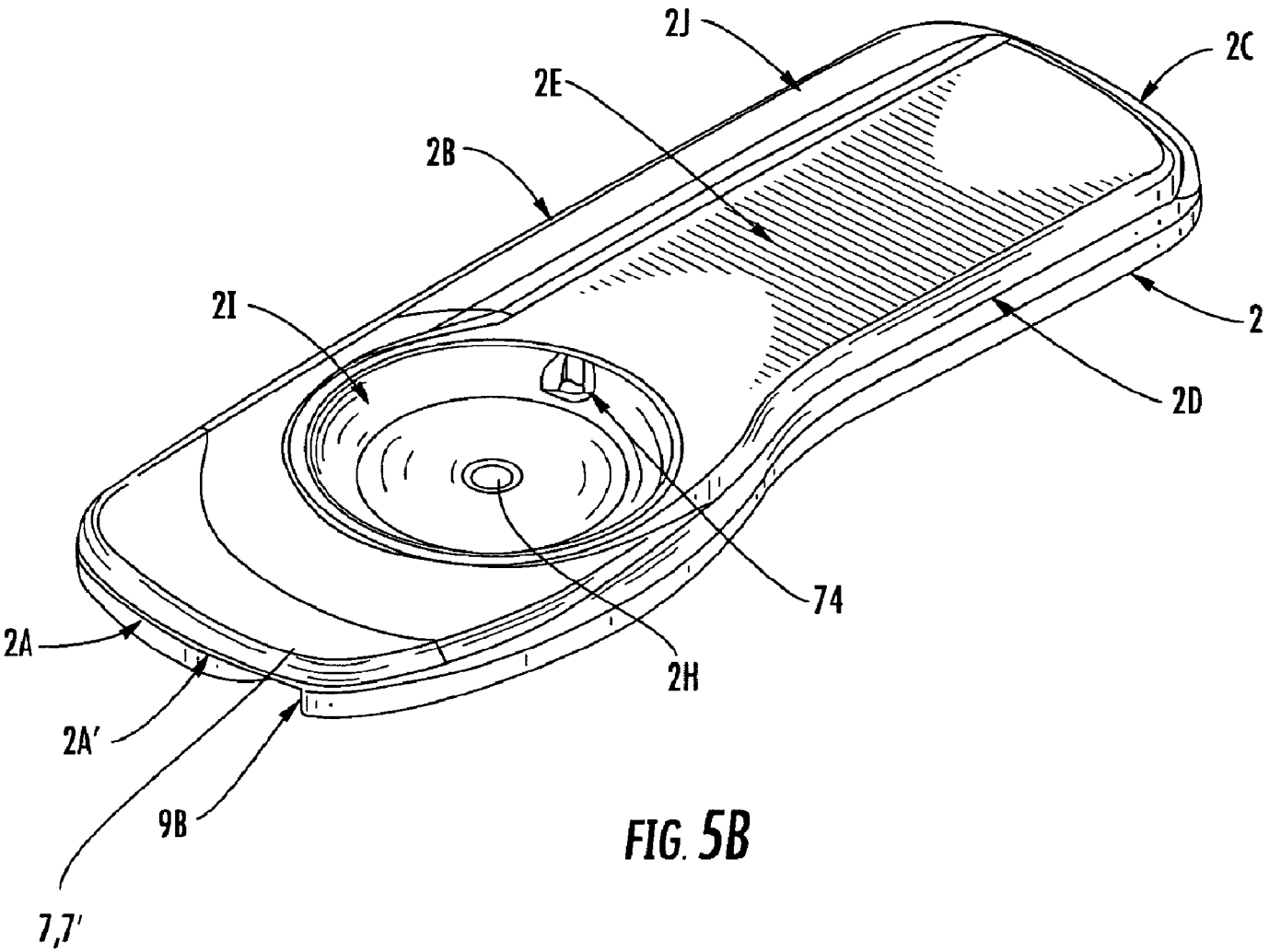
FIG. 5B shows a view of the exterior of the upper housing of the EAS tag of FIG. 1, in accordance with one embodiment.

Adjacent the inner end 7" of the arcuate channel 7, the upper and lower housings 2 and 3 may respectively be provided with further curved walls 59 and 11, which may terminate in wall sections 59A and 11A abutting the side walls 2D and 3D (see, e.g., the embodiments of FIGS. 5A and 6A-6B). The walls 59 and 11 may be outward of the arcuate channel 7 and, with the side walls 2D and 3D, may define a trap area 13, which may prevent access to the spring clamp 6. This trap area 13 may provide a safety measure for blocking unauthorized objects introduced into the arcuate channel 7 of the tag body 1A in an attempt reach the spring clamp 6. Such unauthorized objects, by virtual of their shapes, may enter the trap area 13 when they are each inserted into the arcuate channel 7, thus failing to contact and move the spring clamp 6 to unlock the tag 1.

As noted above, the spring clamp 6 may be adapted to releasably prevent the tack body 4B from being withdrawn from the tag body 1A. In an embodiment, the spring clamp 6 is specifically adapted to accommodate release of the tack body 4B via the arcuate probe 8 moving in the arcuate channel 7. The spring clamp 6 is shown in detail in the embodiments of FIGS. 6A and 6B, the exploded view of FIG. 2, and FIG. 8.

As shown, the spring clamp 6 may include a spring clamp body 14 and jaws 15 and 16. The spring clamp body 14 may include a mounting part 14A extending laterally of the jaw 15 and a release part 14B extending laterally of the jaw 16. The mounting part 14A may include, or form, a mounting aperture 14A'.

Each of the jaws 15, 16 may extend outwardly of the plane of the spring clamp body 14 and then inwardly toward the other jaw. The jaws 15, 16 may, furthermore, terminate in facing edges 15A and 16A. These edges may extend from a common edge 14C of the spring clamp body 14 inwardly toward each other, then curve outwardly away from each other to define an aperture 14C' (typically, circular or elliptical, but may be different shapes in other embodiments) for receiving the tack body 4B. The edges 15A and 16A may then continue in aligned fashion and end in an elongated, lateral slot 14D in the spring clamp body 14. The lateral slot 14D may lie inward of a further clamp body edge 14E, which may oppose the clamp body edge 14C.

A further laterally extending elongated spring sleeve, or spring arm 17, may be attached by a joint area 18 to the side 14E' or the edge 14E bordering the mounting part 14A. The sleeve, spring arm 17, may extend along the length of the edge 14E and may also be out of the plane of the spring clamp body 14.

Figure 4:
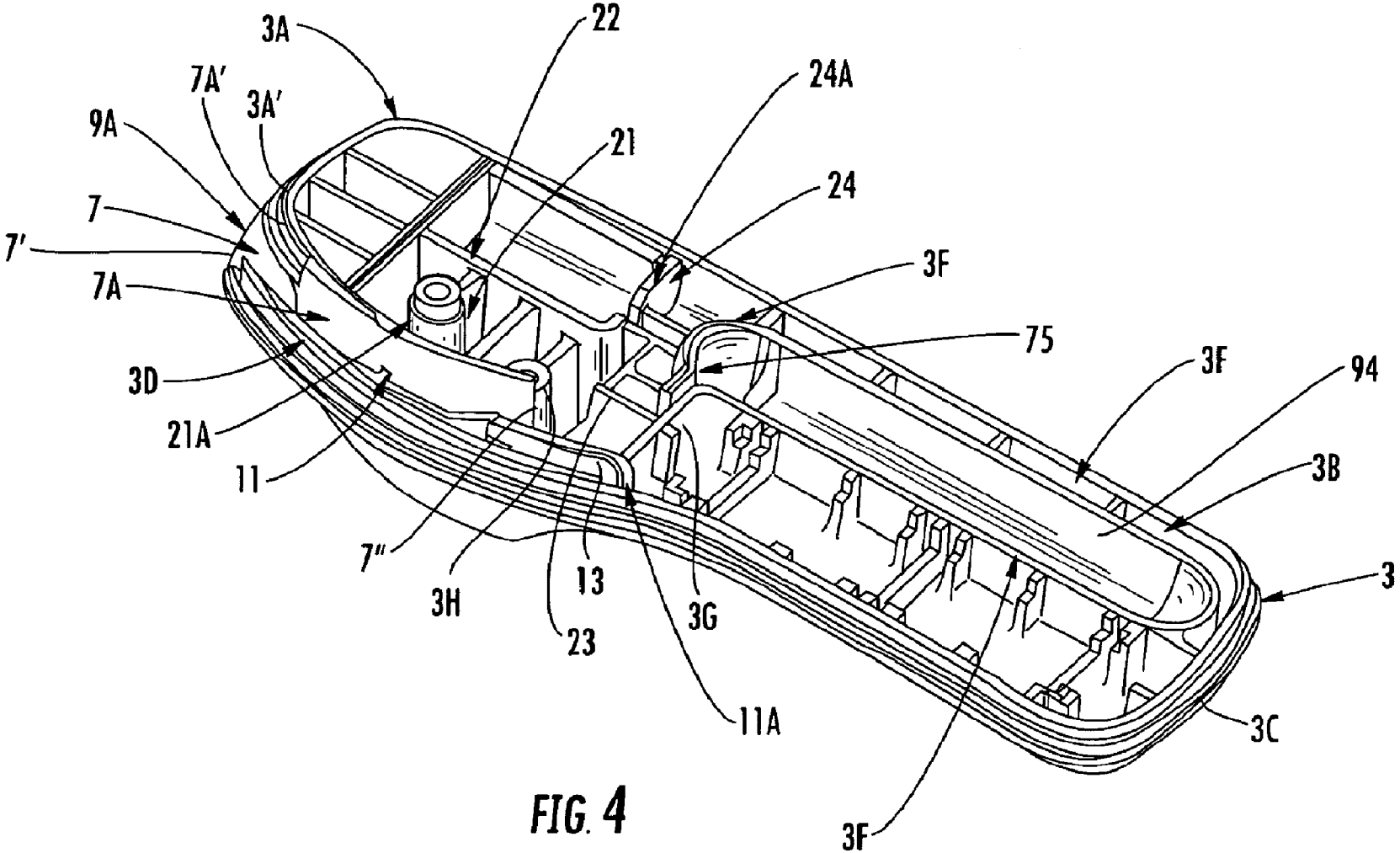
FIG. 4 shows a view of the interior of the lower housing of the EAS tag of FIG. 1, in accordance with one embodiment.

For mounting and supporting the spring clamp body 14, the lower housing 3 of the tag body 1A may include a hollow circular mount 21 with a lip 21A and support walls 22, 23 and 24 (see the embodiments of FIGS. 2, 3, and 4). The spring clamp body 14 may be pivotably mounted, via the mounting aperture 14A' of the mounting part 14A, on the mount 21 with the area of the mounting part 14A adjoining the mounting aperture 14A' supported on the lip 21A. A circular wall 25 of the upper housing 2 and a central cylindrical stud 26 of this housing (see the embodiment of FIG. 5A) may maintain the mounting part 14A in its mounted position, while allowing the mounting part 14A to be rotated. The spring clamp body 14 of the spring clamp 6 may thus be able to pivot about the mounting part 14A as will be described more fully below.

The back end 14A" of the mounting part 14A and the lateral part of the spring clamp body 14 connecting the mounting part 14A and the release part 14B may be supported on the support walls 22 and 24, while the release part 14B may be carried by the wall 23. The spring arm 17 may rest with at least a portion thereof, such as with one end 17A, in a slot 24A in the support wall 24.

When the pointed end 4D of the tack body 4B is introduced in the downward direction through the opening 2H in the upper housing 2, the part 2K (see the embodiment of FIG. 5A) of the upper housing 2, which part may be shaped to fit within the hollow of, or otherwise near, the spring clamp body 14 of the spring clamp 6 above the jaws 15, 16 and may carry the opening 2H, may direct the tack body 4B to the aperture 14C' defined by the facing edges 15A, 16A of the jaws 15, 16. This may cause the jaws 15, 16 to spread open and allow the tack body 4B to pass through the jaws 15, 16.

In an embodiment, when the downward tack body 4B travel is stopped at a desired slot 4C, e.g., a slot that provides a tight fit of the tack head 4A and article 51 to the wall 2E of upper housing 2, the jaws 15, 16 may retract and clutch the tack body 4B within a slot 4C. The facing edges 15A, 16A of the jaws 15, 16 may thus be positioned within a slot 4C of the tack body 4B. In this position, the jaws 15, 16 may prevent or provide resistance to upward movement of the tack assembly 4 since the slot 4C that the jaws 15, 16 are clutching has a smaller diameter than the outer diameter of the tack body 4B. The tack assembly 4 and article 51 may thus become locked to the tag body 1A, and thus to the tag 1. This position of the spring clamp 6, in which its jaws 15 and 16 clutch the tack body 4B within a slot 4C to lock the tack assembly 4 thereto and thus to the tag body 1A, may be referred to as the "locking position." When the tag 1 is assembled, the spring arm 17 of the spring clamp 6 may bias the spring clamp 6 toward this locking position. Thus, if the spring clamp 6 is not in contact with the arcuate probe 8, the spring clamp 6 may be biased by the spring arm 17 into the locking position.

In order to release the tack assembly 4 from the tag body 1A, the arcuate probe 8 may now be introduced into the opening of the tag body 1A via rotation of the probe about its rearward end 8B. This may cause the probe to be moved in and guided by the arcuate channel 7 until the L-shaped forward end 8A of the probe reaches and passes into the L-shaped inner end 7" of the arcuate channel 7. In other embodiments, the forward end 8A of the arcuate probe 8 and the inner end 7" of the arcuate channel 7 may be otherwise shaped, such that the forward end 8A may move through the inner end 7" (while unauthorized probes or other elements having different-shaped cross sections may not be able to move through the inner end 7"). This may move the probe end 8A into contact with the part of the common edge 14C bordering the release part 14B of the spring clamp body 14 of the spring clamp 6.

Continued rotational movement of the arcuate probe 8 may then cause a force on the release part 14B. This force, in turn, may cause the spring clamp body 14 to rotate about the mounting part 14A on the mount 21 at the mounting aperture 14A'. The jaws 15, 16 may thus be enabled to spread apart or open and/or moved, such as by rotation in one embodiment, out of their clutching engagement with the tack body 4B due to the force of the tack body 4B, which may be held stationary by the collar 3H, acting on the walls of the aperture 14C'. The aperture 14C' may thus expand or otherwise be moved out of engagement with the tack body 4B, releasing the tack body 4B from the grip or clutch of the jaws 15, 16, thus unlocking the tack body 4B and tack assembly 4 from the spring clamp 6. The tack assembly 4 may now be moved in the upward direction past the jaws 15, 16, via an upward force on the tack head 4A, thereby withdrawing and separating the tack body 4B from the tag body 1A and the article 51 from the tag 1.

During movement, such as by rotation in one embodiment, of the spring clamp body 14 of the spring clamp 6 as a result of the in-plane force exerted by the arcuate probe 8, the spring arm 17 at the joint 18 and/or elsewhere may be compressed, bent, or otherwise moved due to the force. After the tack assembly 4 is separated from the tag body 1A, the arcuate probe 8 may be rotated or otherwise moved in the reverse direction. This reverse rotation or other movement may disengage the arcuate probe 8 from the release part 14B of the spring clamp body 14 as the arcuate probe 8 is withdrawn from the arcuate channel 7. The force on the spring clamp body 14 may thus be removed and the spring arm 17 may expand, unbend, or otherwise bias the spring clamp body 14 toward its locking position. This may cause the spring clamp body 14 to rotate in the opposite direction about the support area 14A. The spring clamp body 14 may thereby be brought back to its original position (or nearly so), the locking position, awaiting reentry of the tack body 4B for again attaching an article to the tag 1.

Embodiments of detaching assemblies that incorporate the arcuate probe 8, and that can be used to rotate the spring clamp body 14 of the spring clamp 6 as described above to detach the tack assembly 4 from the tag 1, are fully illustrated in the '419 patent, which has been incorporated herein by reference. It should be noted that the spring clamp body 14 of the tag 1 may be constructed of spring sheet metal in one embodiment. The arcuate probe 8, in turn, can be constructed of hardened tool steel in an embodiment. Other materials may be substituted or included in the spring clamp 6, its spring clamp body 14, and/or the arcuate probe 8 in other embodiments.

As described above, the EAS tag 1 may be adapted so that access to the spring clamp 6 for releasing the tack assembly 4 is made difficult for other than authorized personnel. However, defeats have occurred in on embodiment of an EAS tag by using a bent piece of common electrical "fish tape" to unlock the spring clamp 6 from the tack assembly 4, and thus to unlock the tag 1. Fish tape is a relatively rigid but bendable steel wire used to pull electrical wires through conduit. In one embodiment, an abutment, or a spring gate that comprises an abutment and a leaf spring, may be disposed within the arcuate channel 7 of the tag 1 to increase the difficulty of using the fish tape to unlock the tag 1. Examples of the abutment and spring gate that may be employed include the abutment 254 and spring gate 265 embodiments described below with respect to FIGS. 14 and 15.

Referring to the embodiment shown in FIG. 7, there is a section B-B through the EAS tag 1 of FIG. 1 with the probe 8 inserted in the arcuate channel 7 of the tag 1. FIG. 7 also shows the different welding locations of the upper housing 2 and lower housing 3 of one embodiment. Embodiments of detachers are fully disclosed in the '419 patent, and in U.S. Pat. No. 5,535,606. By not holding the tag 1 down firmly in the detacher, the tag 1 may not release the tack assembly 4 and detaching may have to be repeated; the slight vertical misalignment of the arcuate probe 8 to the tag 1 may not cause damage. But if the abutment 254 is in place and has a narrow horizontal portion of the L-shaped opening 258 (described below), a slight vertical misalignment may cause the portion of the arcuate probe 8 near the end 8A (having an L-shaped cross section) to miss the horizontal portion of the opening 258 and engage the solid part of the abutment 254 and potentially damage the tag 1 and/or the detacher. Alignment of the vertical portion of the arcuate probe 8 near its end 8A and the vertical portion of the opening 258 may not be of concern in one embodiment because the alignment may be accurately controlled by the tight horizontal nesting of the tag 1 in the detacher.

Figure 8:
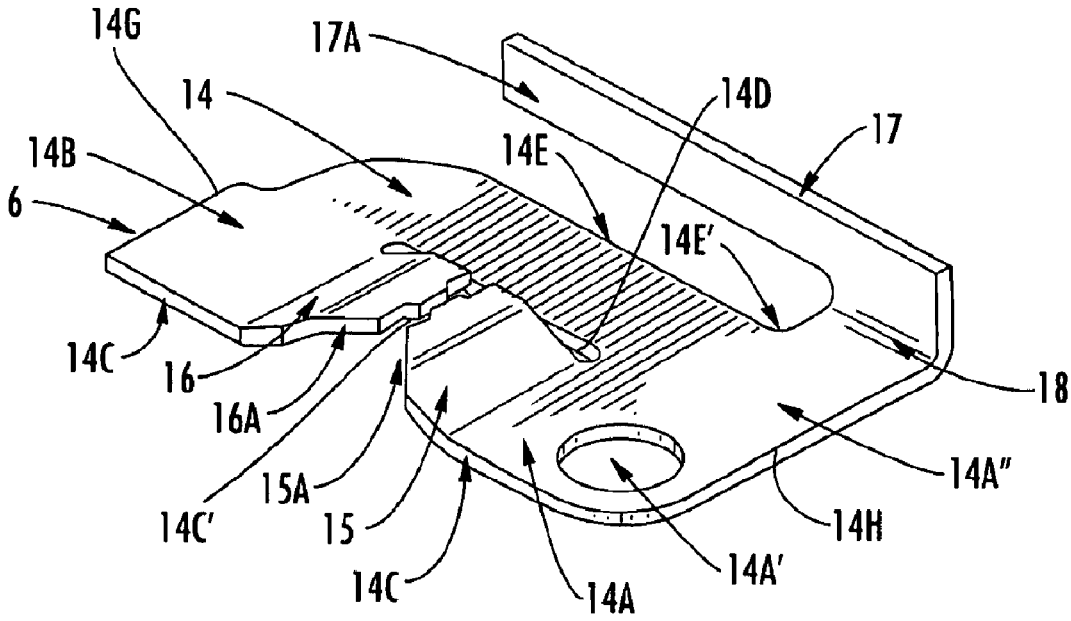
FIG. 8 shows a detailed view of the member, or spring clamp, in accordance with one embodiment.

The embodiment of FIG. 8 shows the detail of the spring clamp 6, or spring clamp, and includes elements 14, 15, 16, and 17, as described above and herein. In various embodiments, the spring clamp 6, along with the portion of the tag 1 in which the spring clamp 6 is disposed, may be alternatively configured.

For example, in one embodiment, the spring clamp 6 may not include the mounting aperture 14A' and the tag 1 may not include a mount 21. In this embodiment, the tag body 1A of the tag 1 may include guides each having a face positioned adjacent and parallel to one of the sides 14G and 14H of the spring clamp 6. Because of this positioning, the guides may restrict movement of the spring clamp 6 to a substantially linear direction parallel to the faces of the guides and the sides 14G and 14H of the spring clamp 6. Thus, when the arcuate probe 8 contacts the spring clamp 6, the spring clamp 6 may be forced to move linearly away from the position in which the tack assembly 4 (and possibly an article 51) is locked thereto. The guides may be walls or other structures, and may be integral with one of the upper housing 2 and lower housing 3 of the tag 1.

In various other embodiments, other guide interfaces may be used to assist movement of the spring clamp 6 in the linear direction. For example, the spring clamp 6 may have a set of slots formed in the spring clamp body 14. The slots may be parallel to the sides 14G and 14H of the spring clamp body 14. The slots may conform to corresponding guide rails formed in the lower housing 3 or other portion of the tag 1. The slot-rail interface may assist in moving the spring clamp 6 in a linear direction. In another example, the lower housing 3 may have a pair of guide posts making contact against corresponding sides 14G and 14H of the spring clamp 6. The guide posts may be positioned to limit rotational movement while emphasizing linear movement of the spring clamp 6. In yet another example, the spring clamp 6 may have flanges attached to sides 14G and 14H. In this embodiment, the lower housing 3 may have a pair of corresponding slots to accommodate the flanges, and may allow the flanges to move in a linear direction while preventing or limiting rotational movement. The embodiments are not limited with respect to these and other structures to assist guiding the spring clamp 6 in a linear direction, whether parallel to the sides 14G and 14H of the spring clamp 6.

In other embodiments, the spring clamp 6 and tag 1 may be configured such that the spring clamp 6 may move in a combination of linear and rotational movement by force of contact with the arcuate probe 8. For example, the tag 1 may include guide posts restricting initial movement of the spring clamp 6 to a linear direction parallel to sides 14G and 14H. Then, after the spring clamp 6 has moved linearly past the guide posts, the spring clamp 6 may rotate, such as about a point or portion near the joint 18. This tag 1 embodiment may not include a mounting aperture 14A' or mount 21.

In another embodiment, the tag 1 includes guides, the mount 21, and the spring clamp 6 including the mounting aperture 14A'. When subject to the unlocking force of the arcuate probe 8, the spring clamp 6 may thus move out of the locking position by pivoting slightly about the mounting aperture 14A' while being biased to otherwise move linearly along the guideposts (or part of the spring clamp 6 may move linearly by deforming), for a combination of rotational and linear movement.

In another embodiment, the spring clamp is a clutch lock having jaws to retain the tack assembly 4 in the locking position. The clutch lock may have a curved cross section with a concave face facing the lower housing surface of the tag. The jaws may be spread apart by flexing the jaws of the clutch lock using a detacher to at least partially bend the clutch lock jaws more than the initial configuration such that the cross section of the clutch lock is more gradually curved or straight. That flexure may cause the jaws to be moved out of the locking position, and the tack body 4B of the tack assembly 4 may be moved from the jaws and unlocked from the tag body. In this embodiment, the detacher does not include an arcuate probe, but instead may include an unlatching mechanism and associated tag body design such as that of a Sensormatic Gator® or Ultra*Gator® security tag or another type of security tag, modified to include an ink vial compartment in its tag body to contain ink therein, and possibly also modified to include an ink routing structure, such as described herein with respect to the tag 1, for example.

In each of various other embodiments, the retaining device may not be a spring clamp, but may include any other device for retaining a tack assembly 4 in the locking position, and thus locking the tack assembly 4 to the tag body. The associated tag may be designed such that the retaining device may be disposed in the tag body. In one embodiment the retaining device may include a ball clutch having two or more balls. For example, in one embodiment, the tag may be similar to the Sensormatic AMT-1000 tag having a three-ball clutch to retain a tack assembly in the locking position. That tag may be modified to include an ink vial compartment in its tag body to contain ink therein, and possibly also an ink routing structure, such as described herein with respect to the tag 1, for example. The ball clutch may be magnetically actuable in an embodiment, such that a magnetic detacher may move the ball clutch out of the locking position by magnetic force.

Figure 16:
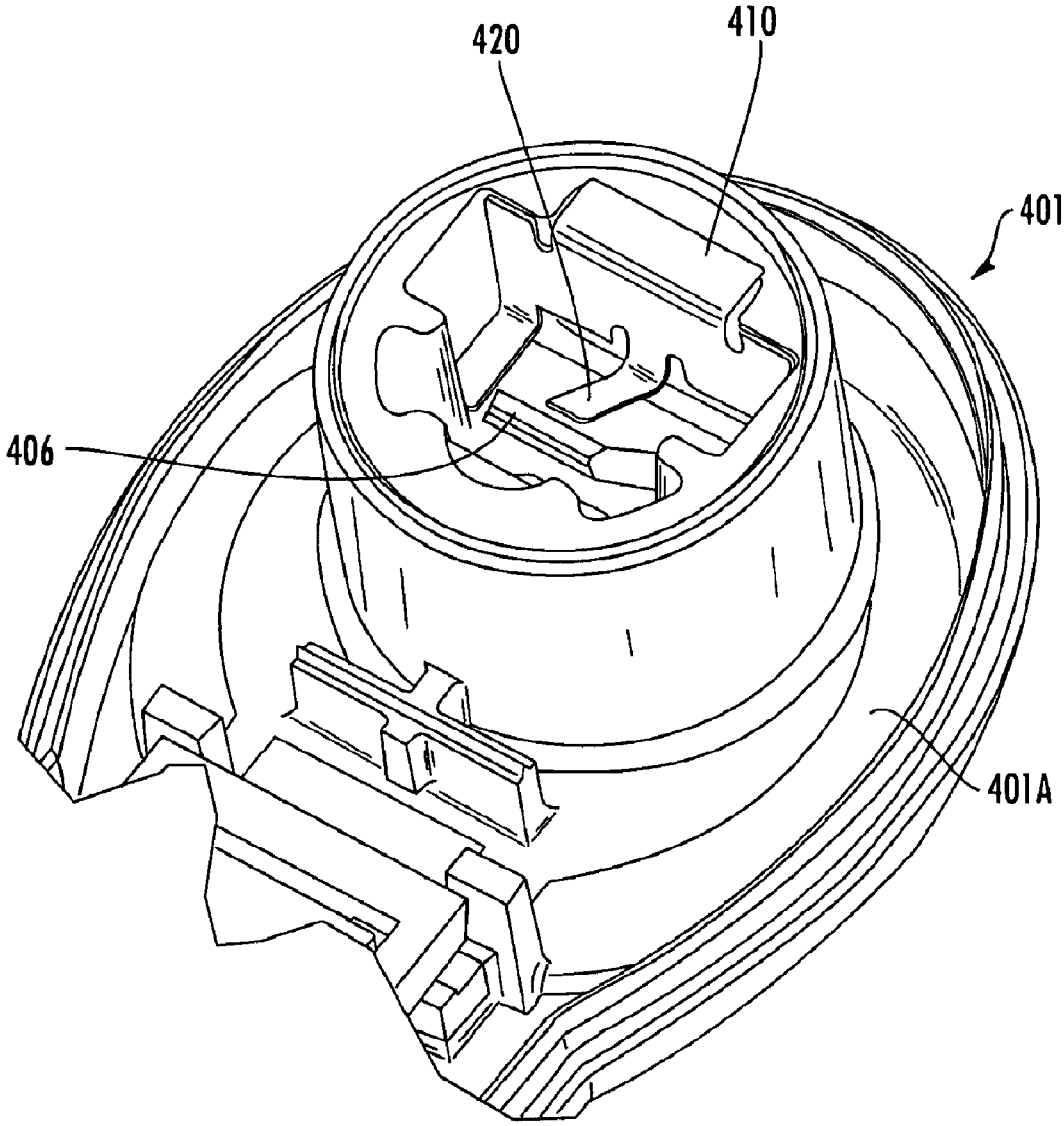
FIG. 16 shows a perspective view of a portion of an EAS tag having a retaining device including a wedge, in accordance with one embodiment.

In another such embodiment, the retaining device may include a wedge, which may be biased by a biasing member into a locking position to lock the tack assembly 4 to the tag body. For example, the embodiment of FIG. 16 shows a perspective view of a portion of an EAS tag, tag 401, having a wedge 406. The tag 401 may include a tag body 401A that contains the wedge 406 and also a biasing member 410. The biasing member 410 may include a biasing portion 420, which may be a leaf spring. In other embodiments, the biasing portion 420 may be another type of spring, or another structure configured to bias the wedge 406 toward a locking position.

The tag body 401A may be shaped and sized to contain an ink vial compartment containing ink, and possibly also an ink routing structure, such as described herein with respect to the tag 1, for example. The wedge 406, biasing member 410, and tag body 401A may be shaped and sized such that the biasing member 410 may be positioned adjacent the wedge 406 to bias the wedge 406 toward and into a locking position. This mechanism is described below with respect to the internal side views of the tag 401 embodiments of FIGS. 17-19.

Figure 17:
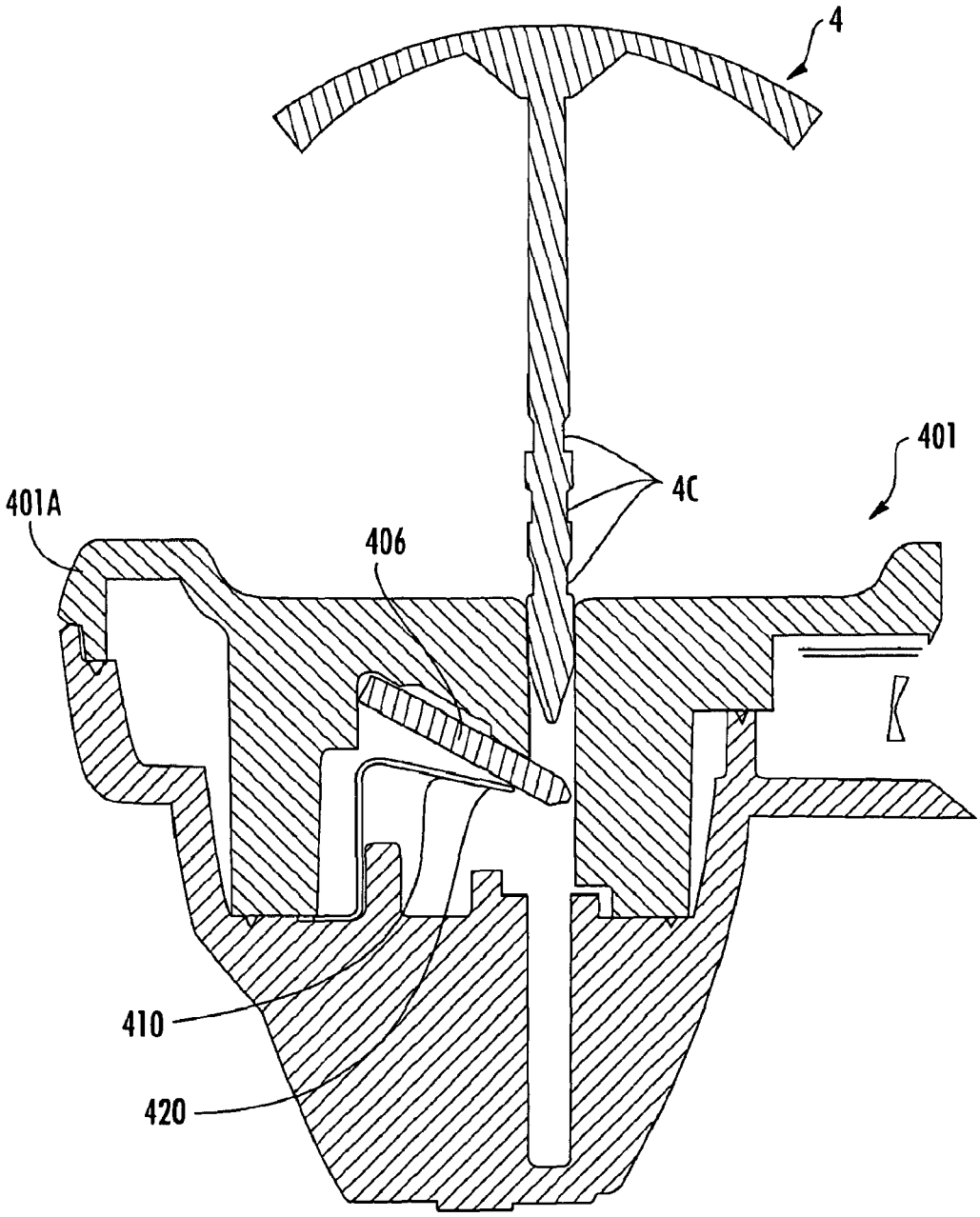
FIG. 17 shows an internal side view of an EAS tag having a retaining device including a wedge, with a tack assembly partially inserted into the tag body, in accordance with one embodiment.
Figure 18:
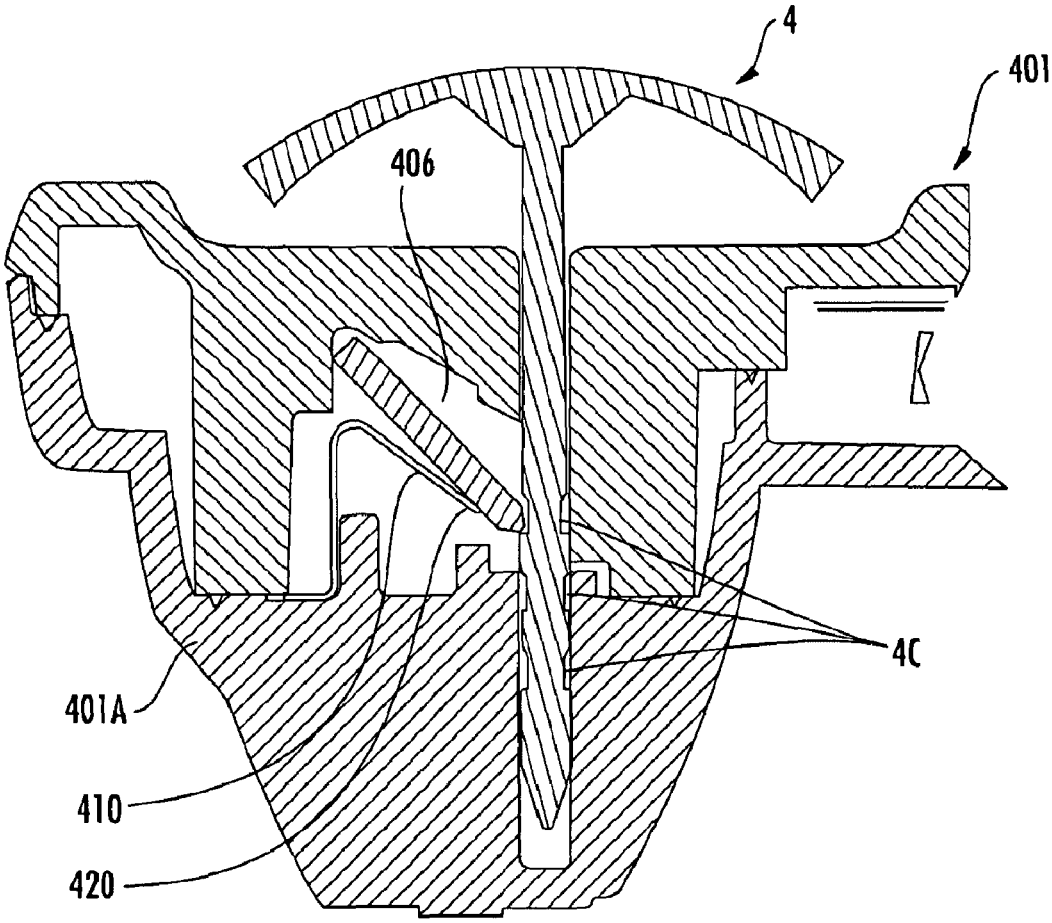
FIG. 18 shows an internal side view of an EAS tag having a retaining device including a wedge, with a tack assembly locked to the tag body by the wedge, in accordance with one embodiment.
Figure 19:
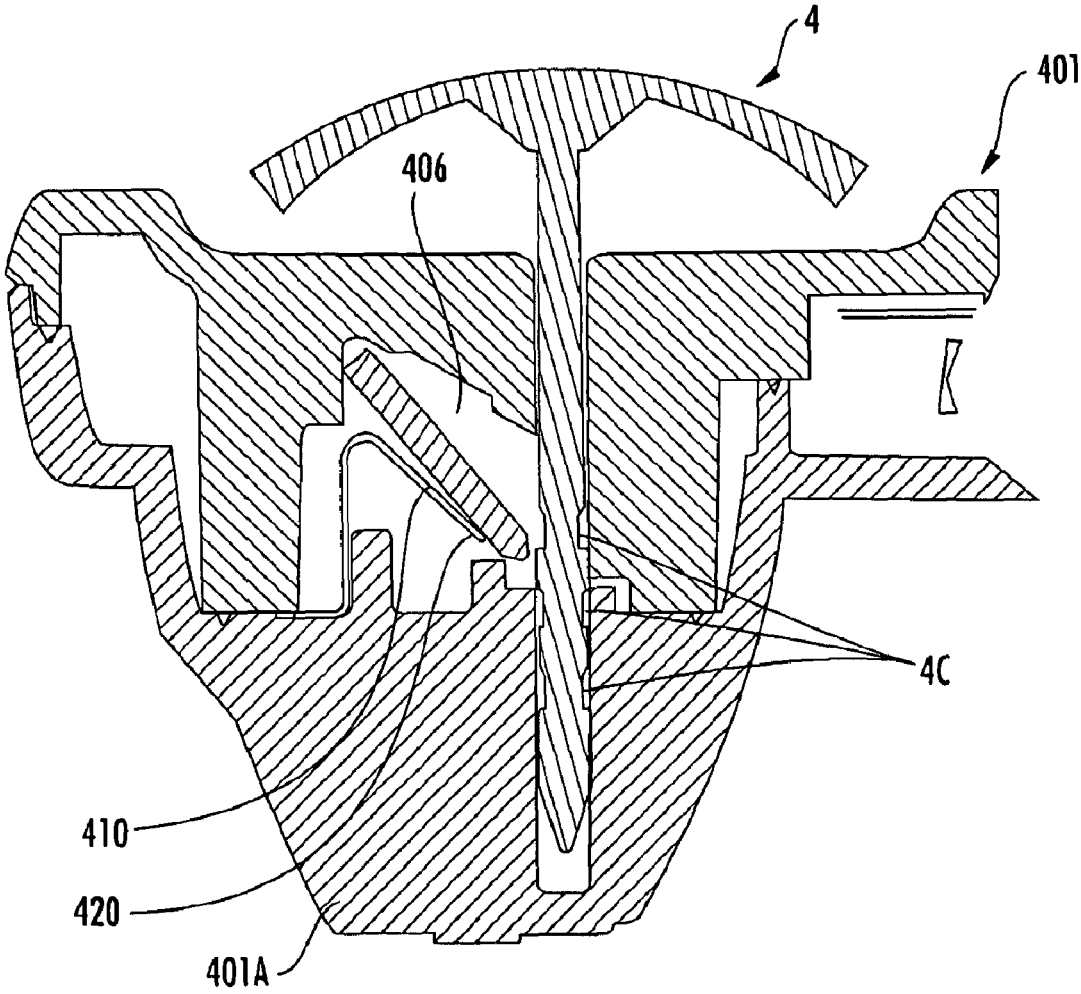
FIG. 19 shows an internal side view of an EAS tag having a retaining device including a wedge, with the wedge moved out of the locking position, in accordance with one embodiment.

In the embodiment of FIG. 17, the biasing member 410 may bias the wedge 406 at least partially across a tag body 401A opening into which a tack assembly 4 has been partially inserted. In the embodiment of FIG. 18, the tack assembly 4 has been further inserted into the tag body 401A such that part of the tack assembly 4 has been pushed past the wedge 406. Because of the positions of the wedge 406 and biasing member 410, the wedge 406 may be biased by the biasing member 410 at least partially into a groove 4C of the tack assembly 4, and thus into the locking position. When in this locking position, the wedge 406 may prevent or increase the difficulty of removing the tack assembly 4 from the tag body 401A. In the FIG. 19 embodiment, the wedge 406 has been moved against the biasing force of the biasing member 410 out of the locking position by a detacher. The wedge 406 may be magnetically actuable such that an appropriate magnetic detacher may cause the movement of the wedge 406 out of the locking position.

Referring to FIG. 2 again, the tag 1 may further include an ink vial 72B, which may be disposed in the tag 1. The tag 1 may also include one or more breaker plates, such as a top breaker plate 71 (shown in FIGS. 9-12) and bottom breaker plate 73. In an embodiment, the tag 1 may include a bladder 72A. Embodiments of elements 71, 72A, 72B, and 73 are described below. In various embodiments, some combination of these elements may be included in the tag 1. For example, the tag 1 may include one or more of elements 71, 72A, 72B, and 73, such as any of the following combinations: only the ink vial 72B; the ink vial 72B with one or both breaker plates 71 and 73; or the ink vial 72B with the ink bladder 72B and none, one, or both of the breaker plates 71 and 73.

Figure 9:
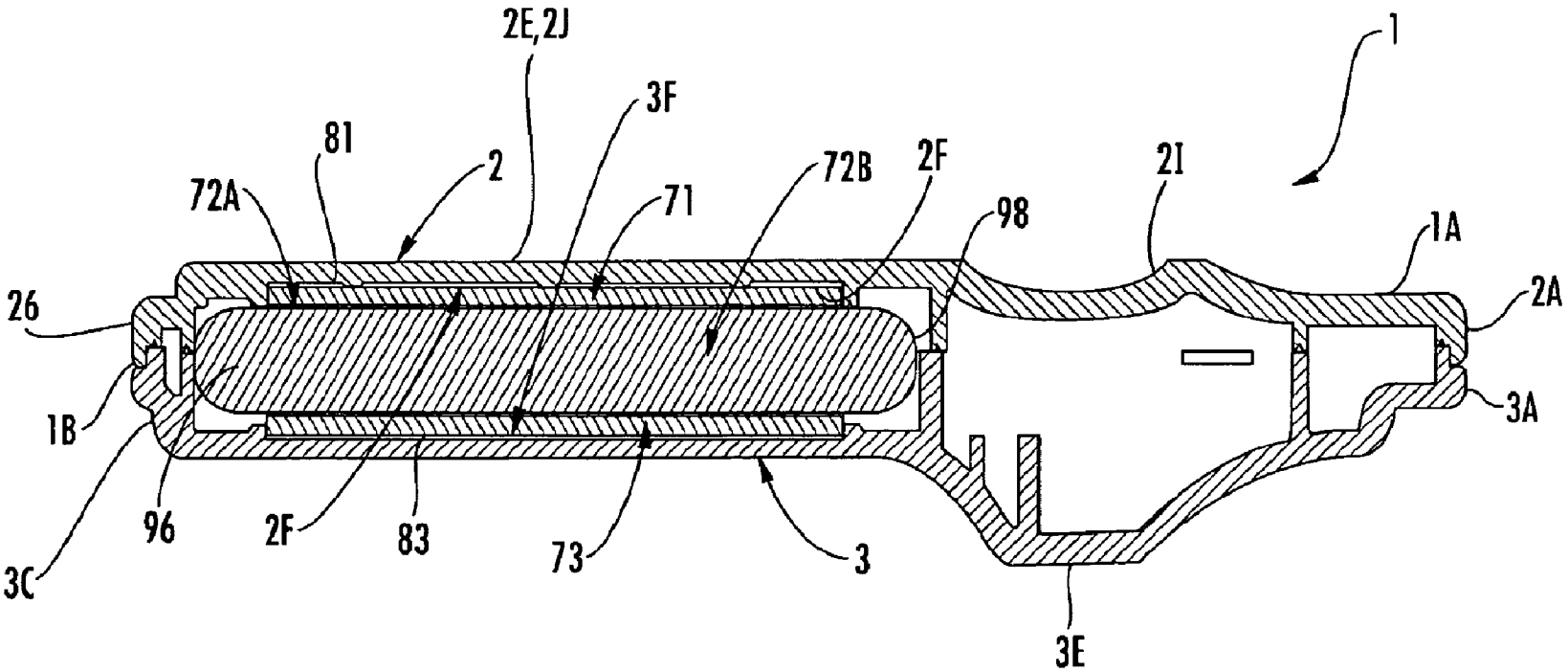
FIG. 9 is a cross section of the EAS tag of FIG. 1 taken along the line C-C, with breaker plates and a vial in place, in accordance with one embodiment.

FIG. 9 shows a cross section of tag 1, taken along the line C-C in FIG. 1, with a top breaker plate 71, bottom breaker plate 73, and an ink vial 72B disposed therein, in accordance with one embodiment. The tag 1 may further include a bladder 72A, which may be disposed at least partially around the ink vial 72B, such as described below.

Referring to FIG. 9, this figure shows the top breaker plate 71, which has been pressed or otherwise disposed adjacent the inner surface 2F of the upper housing 2 of the tag 1. The ink vial 72B and the bottom breaker plate 73 may be placed into position in or adjacent the inner surface 3F of the lower housing wall 3E. In one embodiment, inner surfaces 2F and 3F of the upper and lower housings 2 and 3 may be shaped to define upper and lower breaker plate compartments 81 and 83 to receive the top and bottom breaker plates 71 and 73, respectively. The inner surfaces 2F and 3F may also or alternatively be shaped to form a vial compartment of the tag body 1A to receive the ink vial 72B and may include an upper vial compartment portion 92 (see embodiment of FIG. 5A) and a lower vial compartment portion 94 (see embodiments of FIGS. 2, 4, and 6A-6B), respectively. The tag body IA may otherwise include the vial compartment in other embodiments. For example, in various embodiments, the vial compartment may be any space within the tag body 1A in which the vial 72B may be disposed, and the vial compartment may be enclosed, unenclosed, or, as described below, enclosed except for the channel 75 extending therefrom.

Each of the top and bottom breaker plates 71 and 73 may be positioned adjacent the ink vial 72B. In one embodiment, the top and bottom breaker plates 71 and 73 may be positioned adjacent the ink vial 72B such that they "sandwich" the ink vial 72B by being positioned on opposite sides, or approximately 180 degrees from each other about the ink vial 72B in an embodiment where the ink vial 72B is at least partially tubular.

All parts (elements 71, 72A, 73B, and 73) are shown in their normal positions of one embodiment. In this embodiment, the elements 71, 72A, 72B, and 73 stay in the normal position until someone tries to attack the tag, such as described below. These elements may be positioned near the sensor 5. In other embodiments, these elements may be alternatively positioned.

The ink vial 72B may be at least partially tubular or another shape and may completely enclose ink 96. The ink vial 72B may include glass and/or other material such that the ink vial 72B is brittle enough to break when subjected to external forces, such as forces caused by an attempt by a user to cut through the tag 1 or otherwise remove the sensor 5 from the tag 1.

The top and bottom breaker plates 71 and 73 may be thin, elongated elements with faces (see, e.g., bottom breaker plate face 73A in FIG. 2). For example, in an embodiment, the top and bottom breaker plates 71 and 73 may be shaped at least partially like cuboids, with rectangular top and bottom breaker plate faces, respectively, and thin cross sections. As so shaped, the top and bottom breaker plates 71 and 73, in an embodiment where they are positioned to "sandwich" (as described above) the vial 72B when assembled in the tag body 1A, the top and bottom breaker plate faces of the top and bottom breaker plates 71 and 73 may be parallel or close to parallel.

In an embodiment, the faces of the top and bottom breaker plates 71 and 73 may be sized with a length and width close to the axial length and diameter, respectively, of an ink vial 72B that is shaped at least partially tubular. Such a shape for each of the top and bottom breaker plates 71 and 73 may facilitate their crushing the ink vial 72B by a force, such as described below, by upper and lower walls 2E and 3E of upper and lower housings 2 and 3, respectively, at various positions along the axial length of the ink vial 72B.

In other embodiments, the top and bottom breaker plates 71 and 73 and ink vial 72B may be otherwise shaped such that either or both the top and bottom breaker plates 71 and 73 may crush the ink vial 72B by the force at various positions along the length of the vial 72B. The top and bottom breaker plates 71 and 73 may each include a material that may facilitate crushing the ink vial 72B when forced thereon. For example, in an embodiment, the top and bottom breaker plates 71 and 73 may each include aluminum. In other embodiments the top and bottom breaker plates 71 and 73 may each include another metal and/or a plastic or other material.

Thus, the tag 1 may be a tag for an EAS/expulsion detrimental substance system, and the ink vial 72B, along with one or more of elements 71, 72A, and 73, may be for benefit denial. The tag 1 may do so by inclusion of ink 96 in the ink vial 72B to prevent the tag's EAS portion, the sensor 5, from being disabled or discourage one from disabling it. This may be done by two different methods or formations in two different embodiments.

The first method and associated formation is shown in the tag 1 of FIGS. 9-12 and 12A, in accordance with one embodiment. FIG. 9 shows the ink vial 72B, bladder 72A, and breaker plates 71 and 73, each of which may be disposed in the tag 1. The ink vial 72B may be disposed at least partially within the bladder 72A. The bladder 72A may be made of rubber and/or another material that is elastic or otherwise may not break before the ink vial 72B breaks when subject to the crushing force of one or both the breaker plates 71 and 73. One or more of the ink vial 72B, bladder 72A, and breaker plates 71 and 73 may be completely sealed in a channel pocket that may be ultrasonically welded to wall 2G by an energy director or other means on wall 3G. In other embodiments, the ink vial 72B, bladder 72A, and possibly also one or both breaker plates 71 and 73 may be otherwise disposed in an enclosed or unenclosed portion of the tag 1.

The ink vial 72B may be disposed adjacent, such as beside, the sensor 5 such that if an attempt is made to cut off or otherwise remove the sensor 5 from the tag 1, the attempt may also break the ink vial 72B and its ink 96 may exit the tag 1 and stain the article 51 or other article the tag 1 is protecting.

Figure 10:
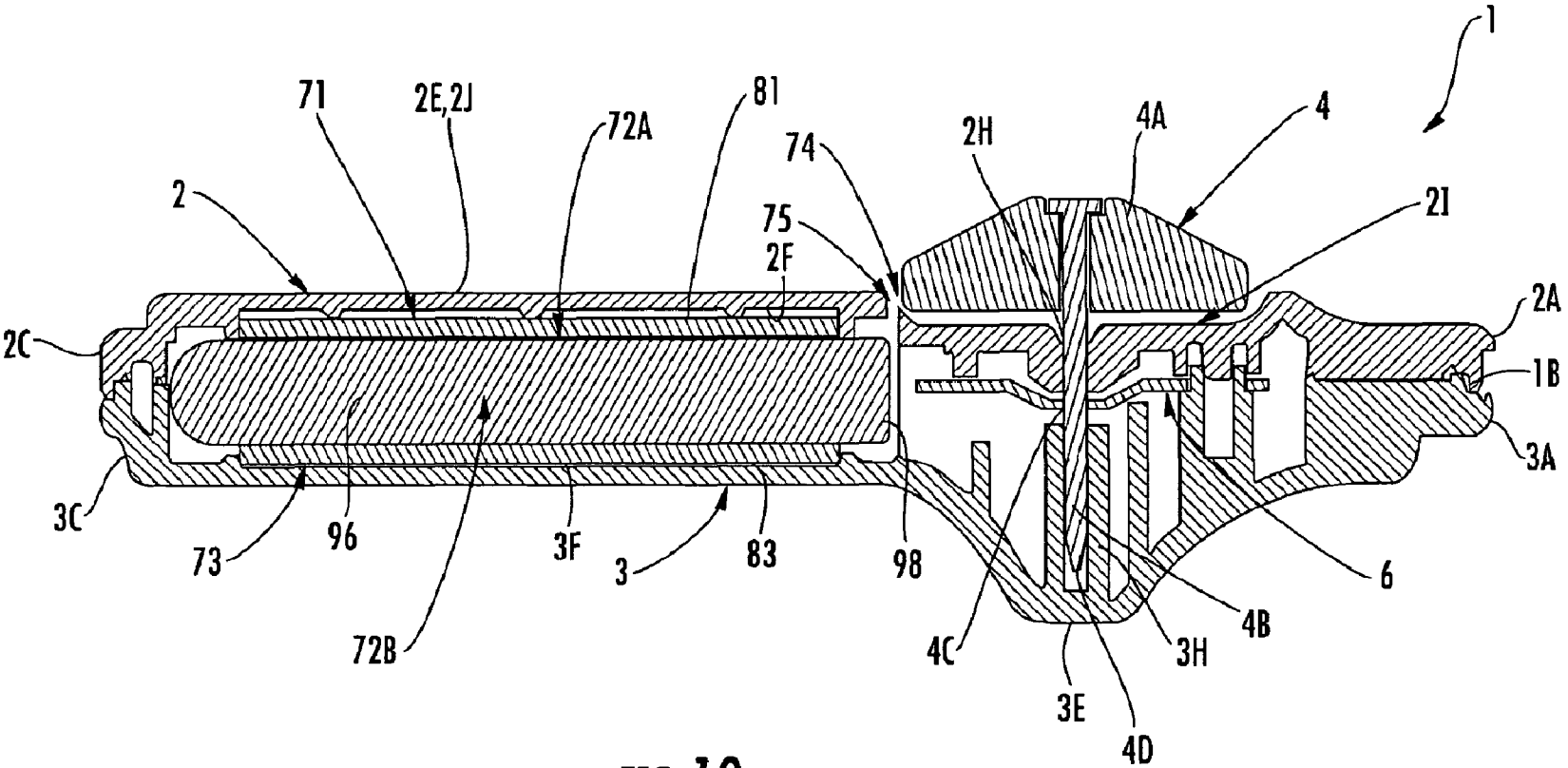
FIG. 10 is a cross section of the EAS tag of FIG. 1 taken along the line D-D, with breaker plates and a vial in place, in accordance with one embodiment.

FIG. 10 shows a view of the tag 1 taken along line D-D of FIG. 1, in accordance with one embodiment. In this embodiment, the ink vial 72B is positioned with one end 98 near a channel 75 that extends from the vial compartment (including upper and lower vial compartment portions 92 and 94, respectively) to the outside of the tag body 1A, thus forming a hole 74 in the tag body 1A. The hole 74 may be in the rampart area 21 of the upper housing 3 of the tag 1. After the ink vial 72B breaks, at least a portion of the ink 96 therein may be forced through the channel 75 and out the hole 74 and thus the tag 1, as explained in more detail below.

The channel 75 and hole 74 it forms may thus be part of an ink routing structure in the tag 1 The ink routing structure may further include, in various embodiments, the ink vial 72B and possibly also the vial compartment and bladder 72A, and/or one or both breaker plates 71 and 73.

In one embodiment, the vial compartment of the ink routing structure completely encloses the ink vial 72B except for the channel 75 extending from the vial compartment to the outside of the tag body 1A. The channel 75 may thus be the only pathway for the ink 96 to exit the vial compartment if the ink vial 72B is broken. Thus, for example, the upper and lower vial compartment portions 92 and 94, respectively, may be secured together so as to form the beginning of the channel 75 that extends out of the tag body 1A and otherwise completely enclose the ink vial 72B. The upper and lower vial compartment portions 92 and 94 may be secured together in various ways, such as by ultrasonic or other welding or securing means, or may be integrally formed.

Figure 11:
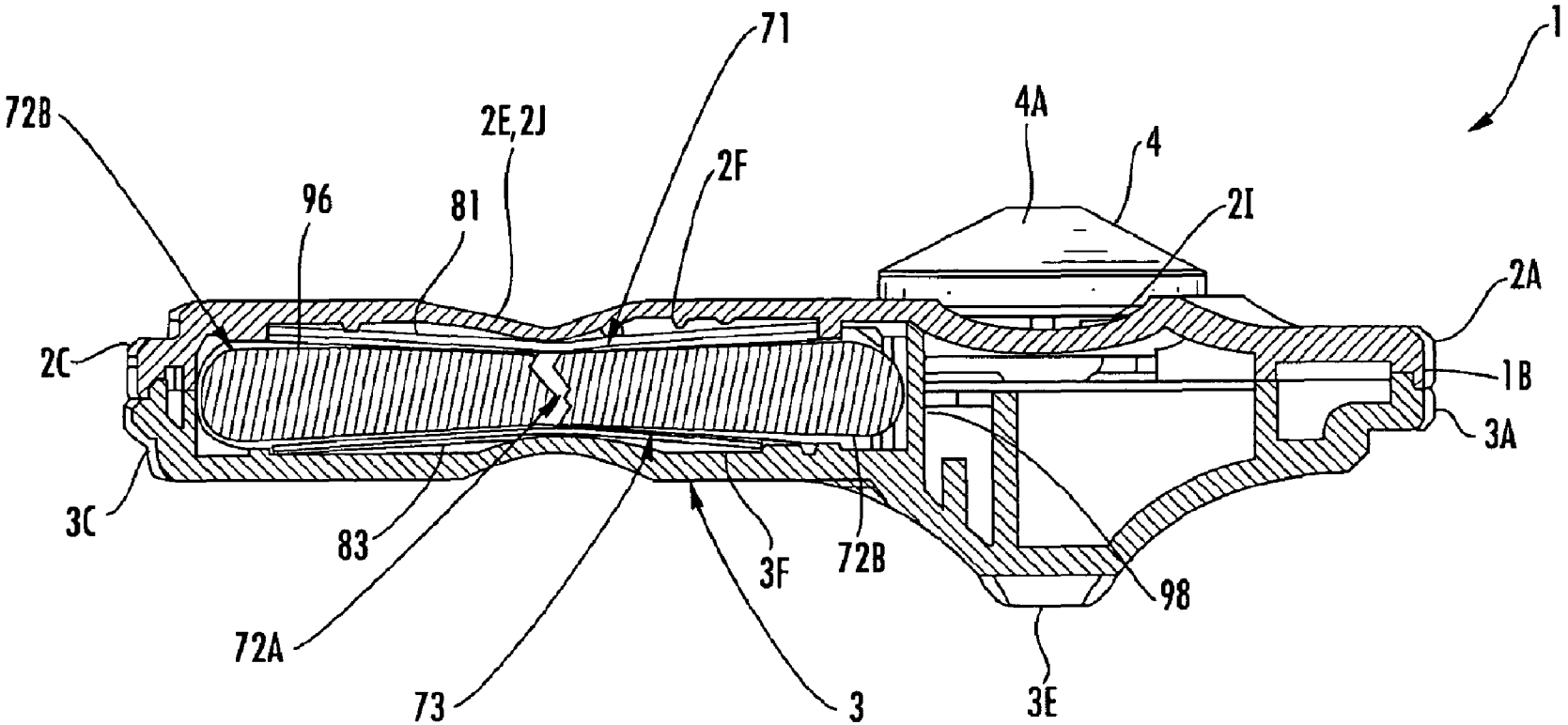
FIG. 11 shows a cross section of the EAS tag of FIG. 1 taken along the line C-C, with breaker plates and a vial in place, and with the breaker plates crushing the ink vial, in accordance with one embodiment.

FIG. 11 shows a cross sectional view of the tag 1 of FIG. 1 taken along line C—C, in which the ink vial 72B is being crushed by the breaker plates 71 and 73, such as by the force of shears or another cutting instrument or an instrument that may compress or squeeze the tag 1. The force may cause the inner surfaces 2F and 3F of the upper and lower housings 2 and 3 to be pushed into the breaker plates 71 and 73, causing the breaker plates 71 and 73 to squeeze the bladder 72A (in an embodiment in which the bladder 72A is included) and break the underlying ink vial 72B. When the ink vial 72B breaks, the ink 96 from the ink vial 72B may flow into the channel 75 (see the embodiments of FIGS. 12 and 12A (which shows a cross sectional view of tag 1 taken along line E-E of FIG. 12)) and exit out the hole 74 in the rampart area 21 and stain the article being protected. In another embodiment, the hole 74 (and thus also the channel 75) may be otherwise shaped and/or positioned in the tag 1. For example, in one embodiment, the hole 74 is formed by the channel 75 in another portion of the exterior (e.g. any part of surface 2J) of the tag body 1A, and the channel 75 is shaped to route ink from the ink vial 72B to the outside of the tag body 1A at the hole 74.

The channel 75 may be any channel or other passageway that may lead from the ink vial 72B and/or vial compartment to the hole 74. When the ink vial 72B is broken, the ink 96 therein may be propelled, by the crushing force, through the channel 75 and out the hole 74. In an embodiment of the tag 1 that includes the bladder 72A, the bladder 72A may be disposed around all but a portion of the ink vial 72B. That portion of the ink vial 72B, uncovered by the bladder 72A and thus exposed, may be the part near and at the end 98 of the ink vial 72B. That exposed portion may be a low percentage of the overall external surface area of the ink vial 72B, or may be another portion. In an embodiment, the exposed portion of the ink vial 72B may be positioned adjacent the channel 75. Thus, the ink 96 expelled by the crushed ink vial 72B may be directed out of the exposed portion of the ink vial 72B and into the channel 75, facilitating movement of the ink 96 out of the hole 74, and onto the article 51 or other article being protected to stain the article.

Thus, the channel 75 and hole 74 of the tag 1, and possibly also the bladder 72A, and possibly also one or both breaker plates 71 and 73, may facilitate expelling the detrimental substance, ink 96 in this embodiment, of the ink vial 72B out of the tag 1 and onto the article 51 or other article being protected.

Figure 13:
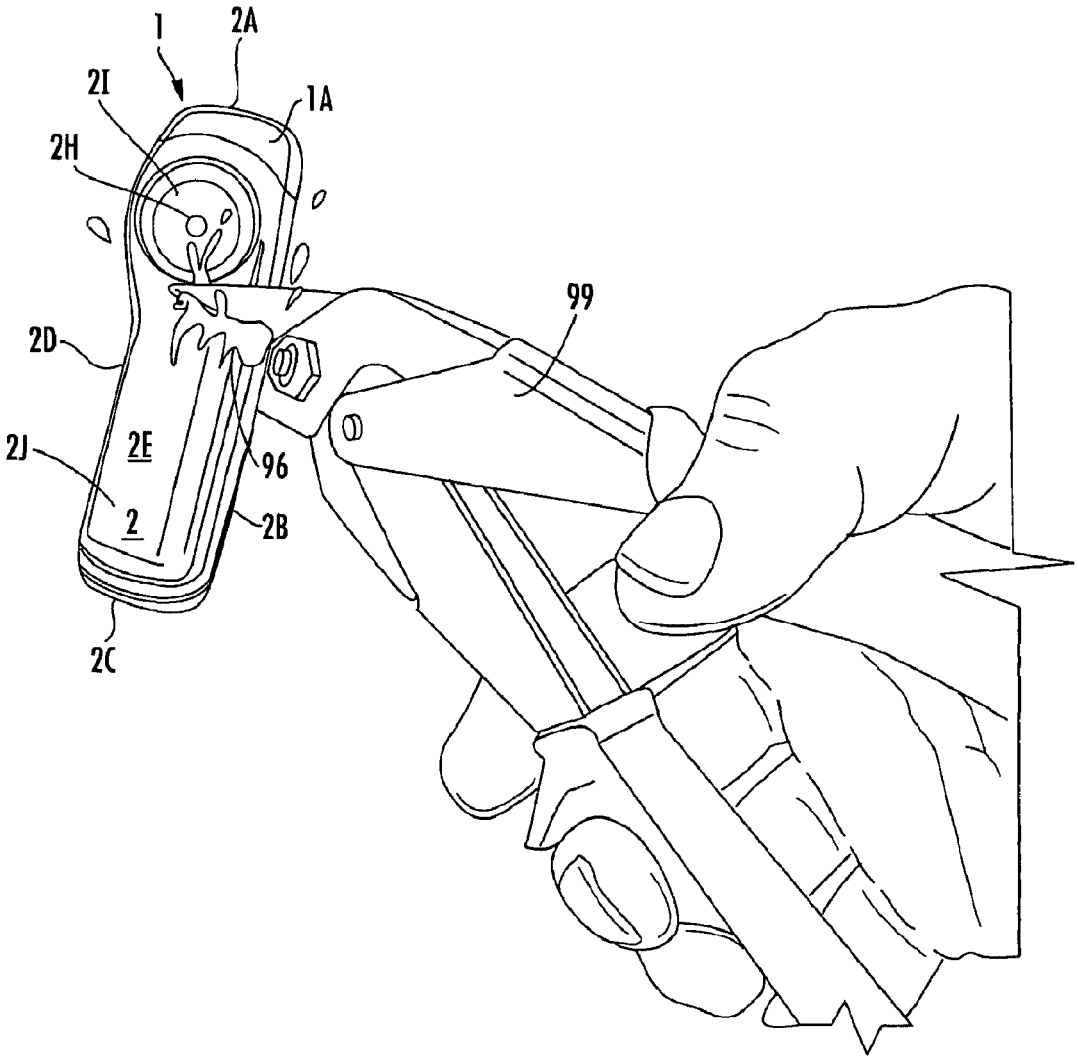
FIG. 13 shows the EAS tag in which ink or another detrimental substance is being expelled from the tag when a thief cuts the tag in half, in accordance with one embodiment.

In another method and associated formation shown in the embodiment of FIG. 13, if someone tries to cut the tag 1, such as with shears 99, and disable the EAS portion (e.g. the sensor 5) of the tag 1, the ink 96 or other detrimental substance may be expelled from ink vial 72B down the channel 75 and out of the hole 74 and also, as shown in FIG. 13, directly out of the tag body 1A where the tag body 1A was cut. The ink 96 may stain the article 51 or other article and also the thief. In other embodiments of FIG. 13, the tag 1 may or may not include one or more of the bladder 72A, one or both breaker plates 71 and 73, and the hole 74 and channel 75.

Thus, for example, in one embodiment, the tag 1 may not include any of the bladder 72A, hole 74, and channel 75, and may thus not include an ink routing structure. In this embodiment, where the tag 1 has its tag body 1A cut into, such as with shears or another cutting instrument, and the vial 72B is broken, the ink 96 therein may be expelled from the tag 1 and onto the article the tag 1 is protecting and possibly also the user of the cutting instrument. An example of another such embodiment is the tag 301 of FIG. 15 (described below), which does not include a bladder, hole, or channel, and also does not include any breaker plate.

Figure 14:
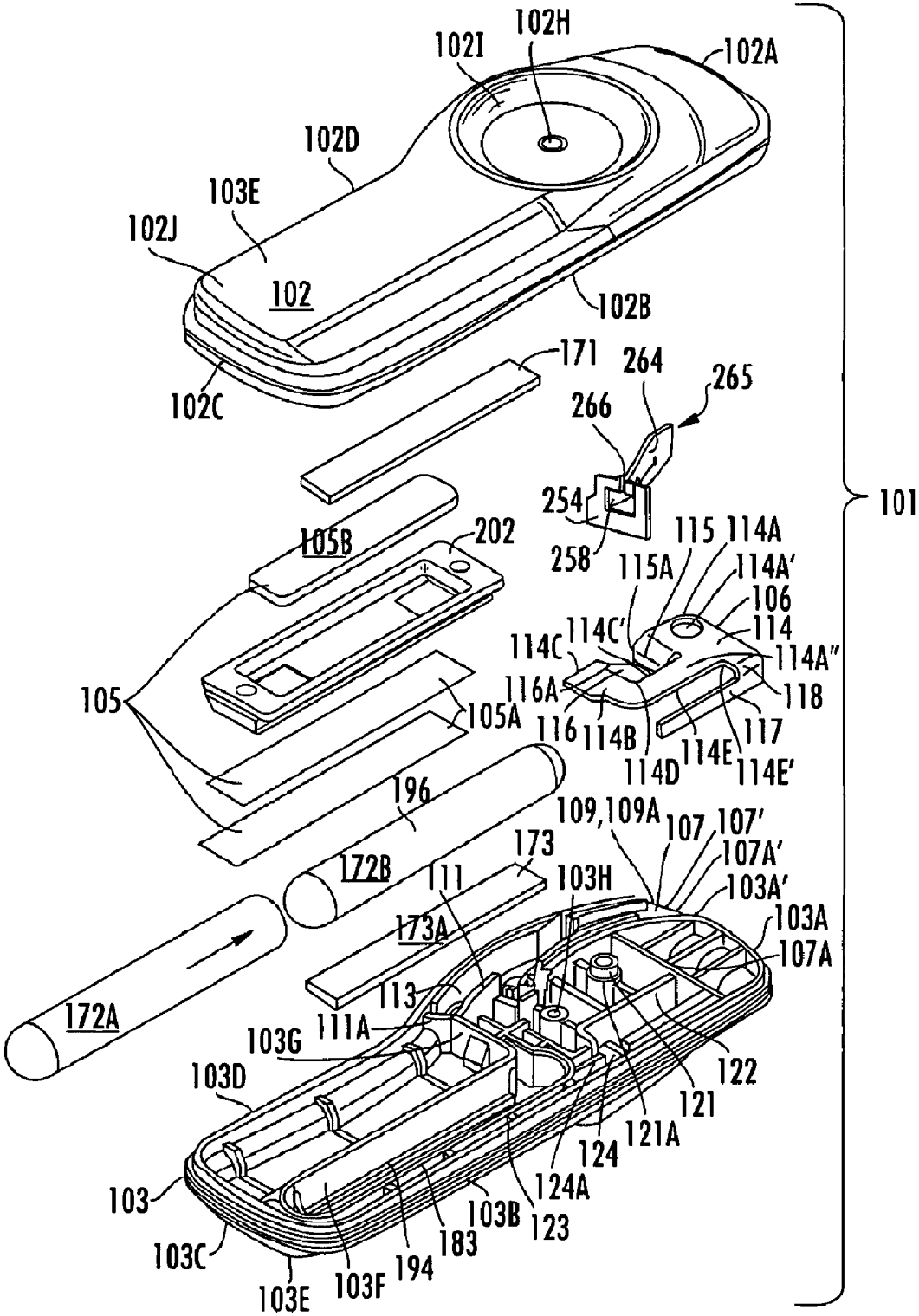
FIG. 14 shows an exploded view of an EAS tag having an ink or other detrimental substance routing structure, in accordance with one embodiment.

FIG. 14 illustrates another embodiment of an EAS tag, tag 101, that includes an ink routing structure, in accordance with one embodiment. The tag 101 may include two breaker plates, top and bottom breaker plates 171 and 173. The tag 101 may also include a sensor 105. The sensor 105 may include one or more linear amorphous resonators 105B and possibly also a magnetized bias 105A, in which case the tag 101 may include a sensor compartment 202 in which the one or more linear amorphous resonators 105B and the magnetized bias 105A may be disposed. The sensor compartment 202 may be configured to position the one or more linear amorphous resonators 105A apart from the magnetized bias 105B.

In FIG. 14, elements 102, 102A-102E, 102H-102J, 103, 103A, 103A', 103B-103H, 106, 107, 107', 107A, 107A', 109, 109A, 111, 111A, 113, 114, 114A, 114A', 114A", 114B, 114C, 114C', 114D, 114E, 114E', 115, 115A, 116, 116A, 117, 117A, 118, 121, 121A, 122-124, 124A, 159, 159A, 171, 172A, 172B, 173, 173A, 183, 194, and 196, of the tag 101 may correspond to elements 2, 2A-2E, 2H-2J, 3, 3A, 3A', 3B-3H, 6, 7, 7', 7A, 7A', 9, 9A, 11, 11A, 13, 14, 14A, 14A', 14A", 14B, 14C, 14C', 14D, 14E, 14E', 15, 15A, 16, 16A, 17, 17A, 18, 21, 21A, 22-24, 24A, 59, 59A, 71, 72A, 72B, 73, 73A, 83, 94, and 96 of the embodiments of the tag 1 of previous FIGS. 1-12 and 12A. The tag 101 may also include one or more elements not shown in FIG. 14 that correspond to elements 1A-1C, 2A', 2F-2G, 2K, 4, 4A-4D, 7", 7A", 7B, 9B, 81, and 92 of tag 1 of FIGS. 1-12 and 12A. In one embodiment, the tag 101 includes an ink routing structure including elements corresponding to the hole 74 and channel 75 described herein. The tag 101 may be assembled and joined or otherwise secured together as described herein with respect to the tag 1 or in another way.

In one embodiment, the tag 101 may include a spring gate 265, which may be disposed at least partially within the arcuate channel 107. The spring gate 265 may include an abutment 254 and a leaf spring 264. The abutment 254 and leaf spring 264 of the spring gate 265 may be integrally formed. The spring gate 265 may be formed of plastic in one embodiment, or another material or materials in other embodiments.

In one embodiment, the abutment 254 is a substantially planar rigid member with a vertical and horizontal opening 258 forming a substantially L-shaped opening. In this embodiment, the arcuate probe 8 may include a corresponding L-shape cross section at and/or near its forward end 8A, such as described herein. The abutment 254 may be disposed in the arcuate channel 107, and the vertical portion of the "L" of opening 258 may be sized and positioned to allow a vertical member of the L-shape of the arcuate probe 8 to closely pass through when the arcuate probe 8 is inserted into the arcuate channel 107 to contact and release or otherwise unlock the spring clamp 106.

The abutment 254 may also prevent, or make more difficult, the insertion of a relatively rigid wire, such as the fish tape described above, formed substantially in the shape of the arcuate probe 8 but without the L-shaped cross section, into the arcuate channel 107 far enough to release the spring clamp 106.

The abutment 254 may include a catch 266 for catching the formed wire and preventing further insertion of the wire into the arcuate channel 107 to contact the spring clamp 106. The catch 266 may be a bent portion of the end of the leaf spring 264. The abutment 254 may be molded into the tag body 11A and may bias the catch 266 against a wall of the arcuate channel 107, such as the inner wall 107A, and in front of the vertical portion of the "L" of the opening 258 in the abutment 254.

A horizontal member of the L-shaped cross-sectional portion of the arcuate probe 8 portion may push against the bias upon insertion of the arcuate probe 8 in the arcuate channel 107, wherein the catch 266 may be pushed away from the vertical portion of the opening 258 in the abutment 254, allowing the arcuate probe 8 to closely pass there through.

In other embodiments, such as described above, the arcuate probe 8 may include a different shape. In these embodiments, the abutment 254 may include an opening 258 that is substantially that different shape or otherwise may allow the different shape of arcuate probe 8 to pass there through, while preventing or increasing the difficulty of extending fish tape or another rigid wire there through to the spring clamp 106 to move the spring clamp 106 out of the locking position.

Figure 15:
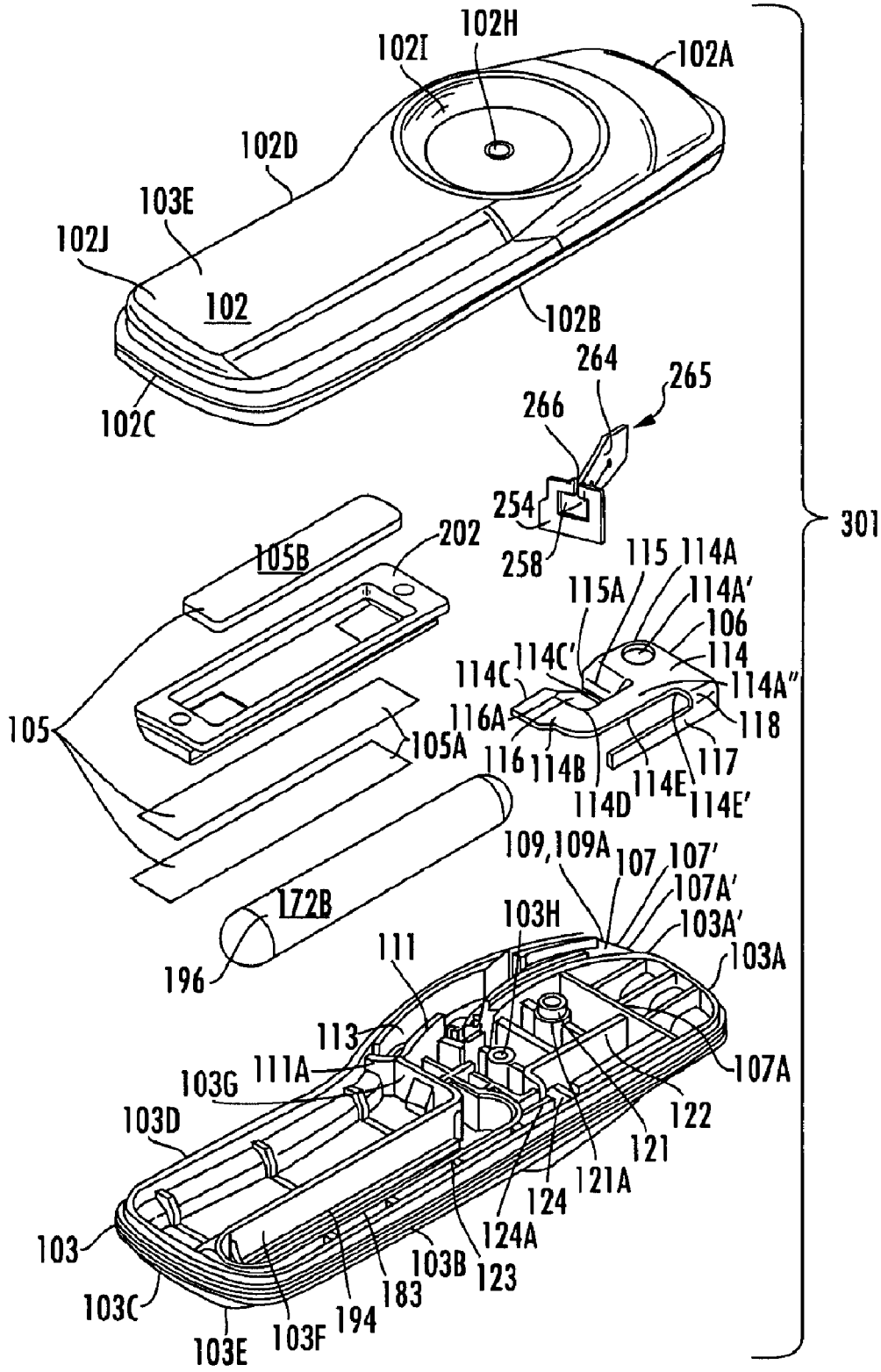
FIG. 15 shows an exploded view of an EAS tag, in accordance with one embodiment.

FIG. 15 shows an exploded view of an EAS tag, tag 301, in accordance with one embodiment. As stated above, the tag 301 is an embodiment of an EAS tag that does not include an ink routing structure. In this embodiment, the tag 301 also does not include any breaker plate. The tag 301 may thus include the numbered elements of FIG. 14 except for the bladder 172A, hole 174, and channel 175. The tag 301 may also not include the top breaker plate 171 and bottom breaker plate 173. Thus, when the tag 301 has its tag body (corresponding to tag body 1A of FIGS. 1-12 and 12A) cut into, such as with shears or another cutting instrument, and the vial 172B is broken, the ink 196 therein may be expelled directly from the vial 72B out the tag 1 where the tag body 1A is cut and onto the article the tag 301 is protecting and possibly also the user of the cutting instrument.

In other embodiments, any of the EAS tag embodiments described herein may include any detrimental substance in addition to, or in place of, the ink 96 in the ink vial 72B or another vial. A detrimental substance may be an ink, die, foul-smelling substance, some combination of the aforementioned three substances, and/or any other matter that permanently stains and/or fouls the article, such as clothing, so as to make the article unattractive and thereby generally unfit for wear. The detrimental substance may be non-toxic and/or non-flammable.

Thus, the ink vial 72B may be replaced in any of the above embodiments with a vial containing any detrimental substance. The vial may be any shaped or sized container that fully encloses the detrimental substance, and the vial compartment may be a corresponding shape and size to enclose the vial, except possibly for a channel extending from the vial compartment. Also in such case, the ink routing structure may be called a routing structure for a detrimental substance where the detrimental substance is contained in the EAS tag.

In another embodiment, the detrimental substance may be contained directly in the tag body of any EAS tag embodiment described herein. Thus, the detrimental substance may not be contained in a vial, but may be contained in an enclosed portion of the tag body.

In various other embodiments, any of the detrimental substance routing structure embodiments described herein may be employed with security tags other than those described herein and other devices. Thus, for example, in one embodiment, a security tag having a locking mechanism other than one including a tack assembly (e.g. tack assembly 4) and spring clamp (e.g. spring clamp 6), and/or not including an arcuate channel (e.g. arcuate channel 7), may include a routing structure for a detrimental substance. Likewise, a security tag not having a detaching mechanism including an arcuate probe (e.g. arcuate probe 8) may include a routing structure for a detrimental substance. Such a security tag may include any tag body having a vial compartment containing a vial that contains a detrimental substance, and a channel extending from the vial compartment to the outside of the tag body, forming a hole in the tag body. Such a security tag may also include a bladder disposed around all but a portion of the vial, and one or more breaker plates.

In various other embodiments, any of the embodiments of an EAS tag described herein, such as EAS tag 1, 101, or 301, may not include a sensor, such as the sensor 5. A tag embodiment, whether or not it includes a sensor, may be referred to as a "security tag."

In one embodiment, an EAS tag includes one or more of the following portions: a tag body; means for attaching said tag body to an article, said attaching means having a part which is received in said tag body; means within said tag body for releasably preventing said part of said attaching means from being withdrawn from said tag body; means within said tag body defining an arcuate channel leading from the exterior of said tag body to said preventing means, said arcuate channel being adapted to receive and guide an arcuate probe to said preventing means for releasing said preventing means from preventing said part of said attaching means from being withdrawn from said tag body; and a detectable EAS sensor, the improvement characterized by; abutment means within said arcuate channel for preventing the insertion of a relatively rigid wire into said arcuate channel far enough to release said preventing means, the rigid wire formed substantially in the arcuate shape of said arcuate probe.

In one embodiment of an EAS tag, the abutment means is a substantially planar rigid member with a vertical and horizontal opening forming a substantially "L" shaped opening to receive a corresponding "L" shape of said arcuate probe, said rigid member being positionable substantially perpendicular in said arcuate channel, said vertical opening sized and positioned to allow a vertical member of said "L" shape of said arcuate probe to closely pass through when said arcuate probe is inserted into said arcuate channel to release said preventing means.

In one embodiment, the abutment means of the EAS tag includes a spring gate assembly for preventing insertion of the rigid wire, said spring gate assembly comprising a catching means for catching the rigid wire and preventing further insertion of the wire into said arcuate channel, said catching means disposed on one end of a spring member, said spring member attachable to said tag body and biasing said catching means against a wall of said arcuate channel and in front of said vertical opening in said rigid member, a horizontal member of said "L" shaped arcuate probe pushing against the bias of said spring member upon insertion of said arcuate prove in said arcuate channel wherein said means for catching is pushed away from said vertical opening in said rigid member allowing said arcuate probe to closely pass there through. In one embodiment, the catching means of the EAS tag is a bent portion of the end of said spring member.

In one embodiment of a rigid planar abutment for use in preventing insertion of a relatively rigid wire formed in the shape of an arcuate probe adapted for insertion into an arcuate channel of an EAS tag for releasing an attaching assembly, the rigid planar abutment is positionable in the arcuate channel and comprising: a substantially planar rigid member having a vertical and horizontal opening that forms an "L" shape corresponding to an "L" shape of the arcuate prove, wherein the vertical member of the "L" shaped arcuate probe closely passes through the vertical opening of the "L" shaped opening in said rigid member. In an embodiment, the abutment including a spring gate assembly for preventing insertion of the rigid wire, said spring gate assembly comprising: a catching means for catching the rigid wire and preventing further insertion of the wire into said arcuate channel, said catching means disposed on one end of a spring member, said spring member attachable to the EAS tag body and biasing said catching means into a recess in a wall of said arcuate channel and in front of said vertical opening in said rigid member, a horizontal member of said "L" shaped arcuate probe pushing against the bias of said spring member upon insertion of said arcuate probe in said arcuate channel wherein said means for catching is pushed away from said vertical opening in said rigid member allowing said arcuate probe to closely pass there through.

In one embodiment of a rigid planar abutment for use in preventing insertion of a relatively rigid wire formed in the shape of a probe adapted for insertion into an arcuate channel of an EAS tag for releasing an attaching assembly, the rigid planar abutment is positionable in the arcuate channel and comprising: a substantially planar rigid member having a vertical and horizontal opening that forms an "L" shape corresponding to an "L" shape of the probe, wherein the vertical member of the "L" shaped probe closely passes through the vertical opening of the "L" shaped opening in said rigid member. The abutment may further include a spring gate assembly for preventing insertion of the rigid wire, said spring gate assembly comprising: a catching means for catching the rigid wire and preventing further insertion of the wire into said arcuate channel, said catching means disposed on one end of a spring member, said spring member attachable to the EAS tag body and biasing said catching means into a recess in a wall of said arcuate channel and in front of said vertical opening in said rigid member, a horizontal member of said "L" shaped probe pushing against the bias of said spring member upon insertion of said probe in said arcuate channel wherein said means for catching is pushed away from said vertical opening in said rigid member allowing said probe to closely pass there through.

Figure 12:
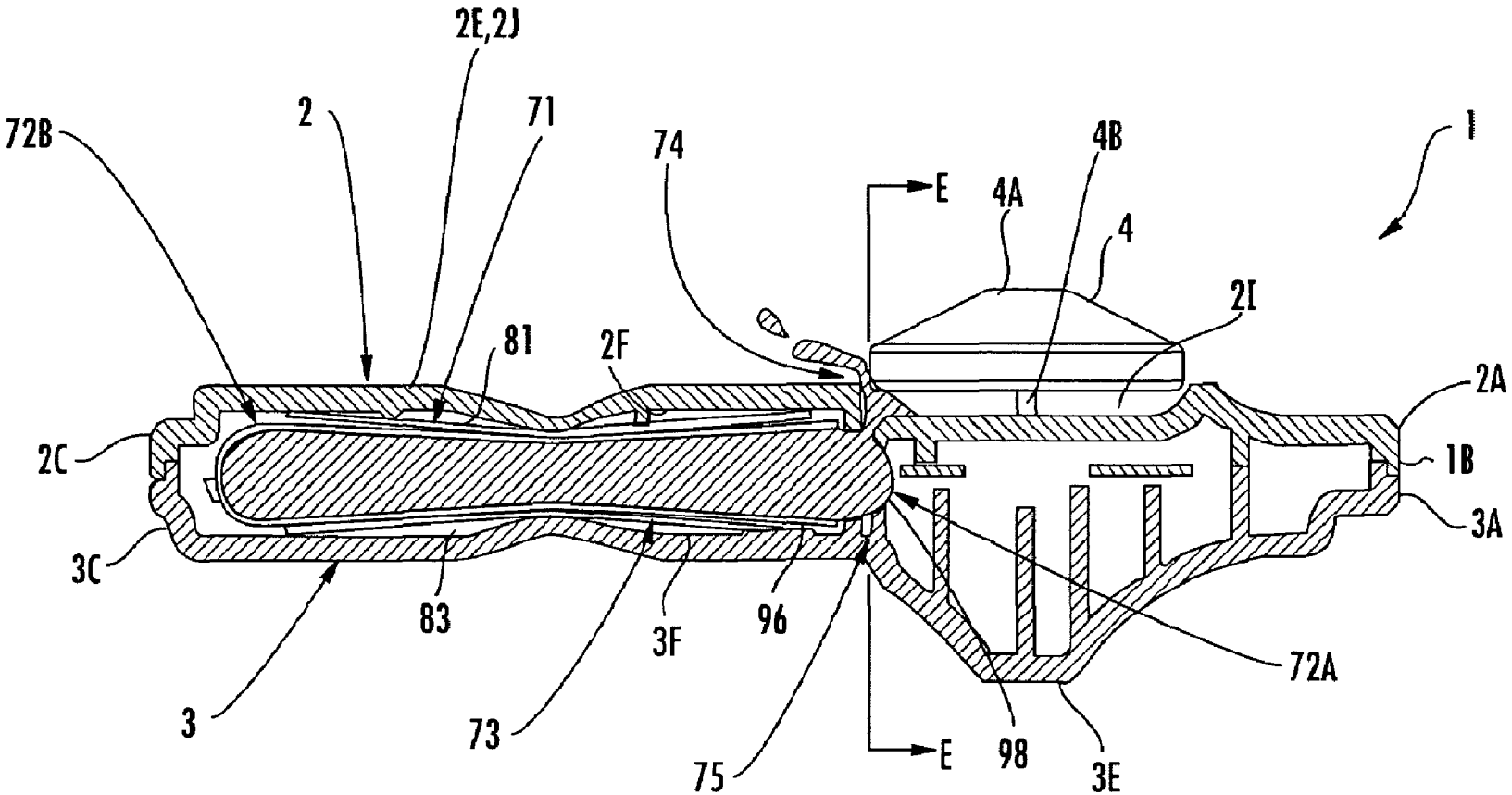
FIG. 12 shows a cross section if the EAS tag of FIG. 1 taken along the line C-C, showing the channel in which the ink will flow out the hole in the rampart area, in accordance with one embodiment.
Figure 12A:
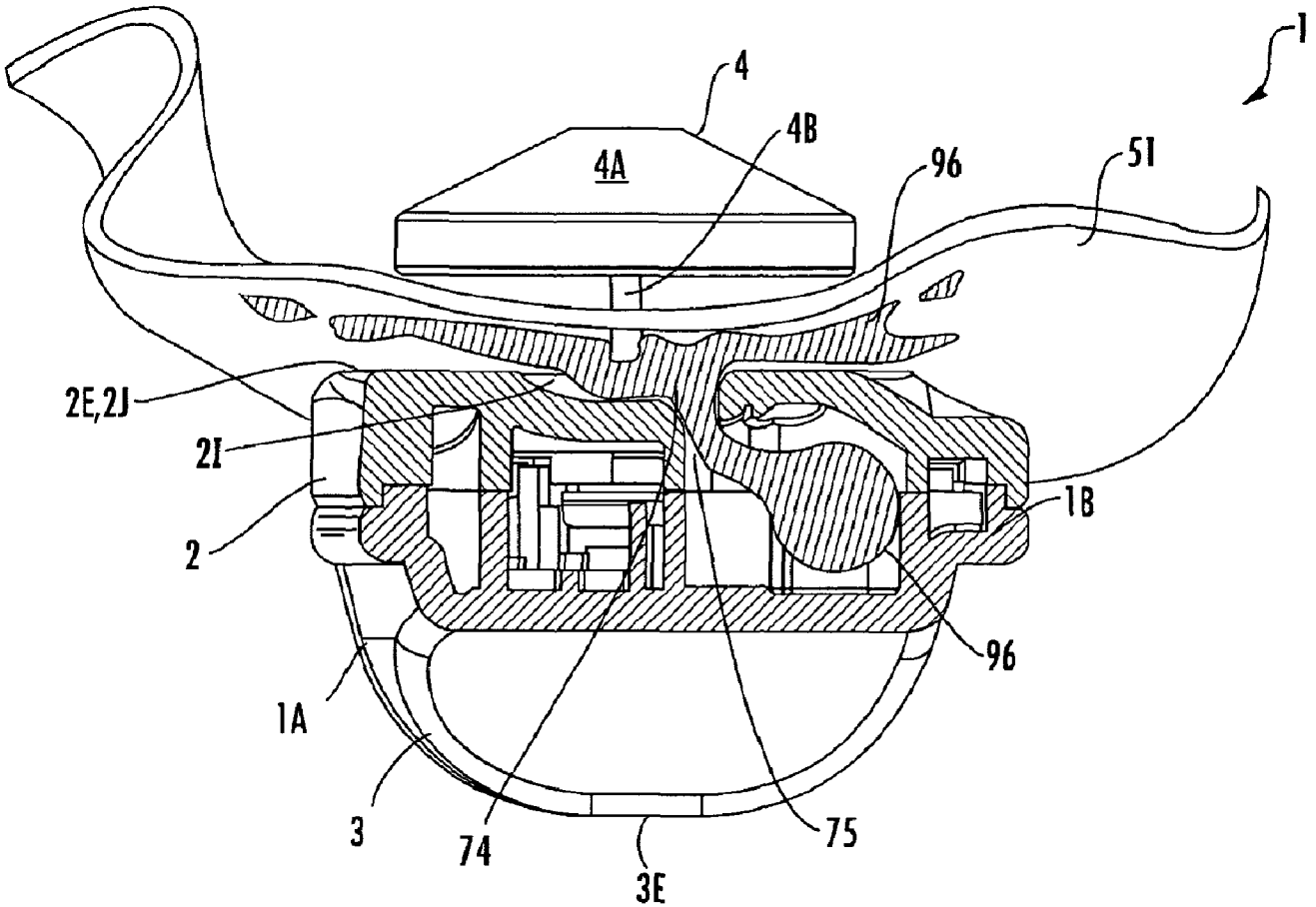
FIG. 12A shows a cross section of the EAS tag of FIG. 12 taken along the line E-E, showing the detrimental substance exiting the tag body through the channel, in accordance with one embodiment.

In various embodiments, an EAS/expulsion detrimental substance system tag combines some or all the aforementioned features but also adds a third feature which is that of a Benefit Denial type product. It may do this by adding an "ink" feature that prevents the tag's EAS portion from being disabled. This may be done by at least two different methods. In the first method such as shown in FIG. 9 in one embodiment, the ink vial 72B may be encased inside of a rubber bladder 72A and, along with breaker plates 71 and 73, completely sealed in a channel pocket that is ultrasonically welded to wall 2G by an energy director on wall 3G. FIG. 11, shows the crushing the ink vial 72B by the breaker plates 71 and 73, such as described above, according to one embodiment. When this happens, the ink from the ink vial 72B may flow into the channel 75 (see, e.g., FIG. 12) and exit out a hole 74 in the rampart area 21 and stain the article being protected. Thus, as shown in FIG. 12 according to one embodiment, if someone tries to cut the EAS tag of FIG. 1, and disable the EAS portion of the tag, then the detrimental substance (e.g. ink) may be expelled from the ink vial 72B down the rubber bladder 72A into the channel 75 and out of a hole 74 and may then stain the article and possibly also the thief.

The second method is shown in FIG. 13 which shows that it someone tries to cut the EAS tag of FIG. 1, and disable the EAS portion of the tag, then the detrimental substance may be expelled from the ink vial 72B down the channel 75 and out of a hole 74 and may then stain the article, and/or the ink may be expelled directly out of the cut portion of the tag 1.

While certain features of the embodiments have been illustrated as described herein, many modifications, substitutions, changes and equivalents will now occur to those skilled in the art. It is, therefore, to be understood that the appended claims are intended to cover all such modifications and changes as fall within the scope of the embodiments.

What is claimed is:

1. A security tag, comprising:

a tack assembly;

a tag body, a portion of the tack assembly being insertable into the tag body, the tag body having an attachment mechanism therein for engagement with the tack assembly;

an elongate vial containing a detrimental substance disposed in the tag body, the elongate vial having a length; and one or more breaker plates disposed in the tag body and positioned adjacent the vial, the one or more breaker plates sized to extend along the length of the vial and being deformable by external forces applied to the tag body whereby the one or more breaker plates will rupture the vial and disperse the detrimental substance when external forces are exerted on the tag body.

2. The security tag of claim 1, wherein the tag body includes an interior cavity defining a vial compartment for containing the vial.

3. The security tag of claim 2, further comprising one or more sensors positioned within the vial compartment adjacent the vial.

4. The security tag of claim 1, further comprising one or more sensors, the one or more sensors to be disposed in the tag body.

5. The security tag of claim 4, wherein at least one of the one or more sensors comprises a magnetic sensor.

6. The security tag of claim 4, wherein at least one of the one or more sensors comprises an acoustic magnetic sensor.

7. The security tag of claim 4, wherein at least one of the one or more sensors comprises a radio-frequency sensor.

8. The security tag of claim 4, wherein at least one of the one or more sensors comprises an RFID sensor.

9. The security tag of claim 4, wherein at least one of the one or more sensors comprises a ferrite assembly.

10. The security tag of claim 4, wherein the one or more sensors are to be positioned adjacent the vial.

11. The security tag of claim 1, further comprising a spring clamp to be disposed in the tag body, the spring clamp to lock the tack assembly to the tag body.

12. The security tag of claim 11, wherein the spring clamp comprises two jaws, the spring clamp to lock the tack assembly to the tack body with the two jaws.

13. The security tag of claim 12, wherein the tack assembly comprises a tack body, the spring clamp to lock the tack assembly to the tack body with the two jaws by clutching the tack body with the two jaws.

14. The security tag of claim 12, wherein the spring clamp comprises a spring arm to bias the spring clamp toward a locking position.

15. The security tag of claim 11, wherein the tag body comprises a support wall having a slot, the spring arm positioned at least partially in the slot.

16. The security tag of claim 11, wherein the spring clamp comprises a spring clamp body, the spring clamp body including a mounting aperture to pivotably mount the spring clamp to the tag body.

17. The security tag of claim 11, wherein the tag body comprises a mount, the spring clamp comprises a spring clamp body, and the spring clamp body comprises a mounting aperture to pivotably mount the spring clamp on the mount.

18. The security tag of claim 1, wherein the one or more breaker plates are sized to have a length approximately the same as an axial length of the vial and a width approximately equal to the diameter of the vial.

19. The security tag of claim 18, wherein the one or more breaker plates comprise two breaker plates disposed on opposite sides of the vial.

20. The security tag of claim 1, wherein the tag body defines an arcuate channel to receive an arcuate probe.

21. The security tag of claim 20, further comprising a spring gate, the spring gate to be disposed at least partially within the arcuate channel.

22. The security tag of claim 21, wherein the spring gate comprises an abutment, the abutment including a catch.

23. The security tag of claim 21, wherein the spring gate comprises an abutment, the abutment having an L-shaped opening.

24. The security tag of claim 1, further comprising a retaining device to be disposed in the tag body, the retaining device to lock the tack assembly to the tag body.

25. The security tag of claim 24, wherein the retaining device includes a ball clutch that includes two or more balls.

26. The security tag of claim 24, wherein the retaining device includes a wedge.

27. A security tag, comprising:

a tack assembly;

a tag body;

the tack assembly to be locked to the tag body, the tack assembly to be unlocked from the tag body using an arcuate probe; and a vial containing a detrimental substance to be disposed in the tag body; and one or more breaker plates disposed in the tag body and positioned adjacent the vial, the one or more breaker plates being deformable by external forces applied to the tag body whereby the one or more breaker plates will rupture the vial and disperse the detrimental substance when external forces are exerted on the tag body.

28. The security tag of claim 27, wherein the tag body includes an interior cavity defining a vial compartment for containing the vial.

29. The security tag of claim 27, wherein the detrimental substance includes ink.

30. The security tag of claim 27, wherein the tag body comprises an upper housing and a lower housing.

31. The security tag of claim 30, wherein the upper housing comprises an upper breaker plate compartment, the upper breaker plate compartment to receive at least one of the one or more breaker plates.

32. The security tag of claim 30, wherein the lower housing comprises a lower breaker plate compartment, the lower breaker plate compartment to receive at least one of the one or more breaker plates.

33. The security tag of claim 27, wherein the tag body includes an interior cavity defining a vial compartment for containing the vial.

34. The security tag of claim 27, wherein the vial has an elongate configuration, and the one or more breaker plates are sized to have a length approximately the same as an axial length of the vial.

35. The security tag of claim 34, wherein the one or more breaker plates comprise two breaker plates disposed on opposite sides of the vial.

36. The security tag of claim 27, further comprising one or more sensors, the one or more sensors to be disposed in the tag body.

37. A security tag, comprising:

a tack assembly;

a spring clamp to lock the tack assembly thereto;

a tag body comprising an arcuate channel to receive an arcuate probe to unlock the tack assembly from the spring clamp, the spring clamp and detrimental substance to be disposed in the tag body;

an elongate vial containing a detrimental substance disposed in the tag body, the elongate vial having a length; and one or more breaker plates disposed in the tag body and positioned adjacent the vial, the one or more breaker plates sized to extend along the length of the vial and being deformable by external forces applied to the tag body whereby the one or more breaker plates will rupture the vial and disperse the detrimental substance when external forces are exerted on the tag body.

* * * * *